US011852367B2

(12) United States Patent
Harada et al.

(10) Patent No.: US 11,852,367 B2
(45) Date of Patent: Dec. 26, 2023

(54) CONTROL DEVICE FOR AIR CONDITIONING APPARATUS, AIR CONDITIONING SYSTEM, CONTROL METHOD FOR AIR CONDITIONING APPARATUS, AND PROGRAM

(71) Applicant: DAIKIN INDUSTRIES, LTD., Osaka (JP)

(72) Inventors: Shinsuke Harada, Osaka (JP); Zuozhou Chen, Osaka (JP); Kaname Maruyama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 112 days.

(21) Appl. No.: 17/559,681

(22) Filed: Dec. 22, 2021

(65) Prior Publication Data

US 2022/0113053 A1 Apr. 14, 2022

Related U.S. Application Data

(63) Continuation of application No. PCT/JP2020/025587, filed on Jun. 29, 2020.

(30) Foreign Application Priority Data

Jun. 27, 2019 (JP) ..... 2019-119322

(51) Int. Cl.

| | |
|---|---|
| ***F24F 11/00*** | (2018.01) |
| ***F24F 11/08*** | (2006.01) |
| ***F24F 11/80*** | (2018.01) |
| ***F24D 19/10*** | (2006.01) |

(Continued)

(52) U.S. Cl.

CPC ..... *F24F 11/80* (2018.01); *F24D 19/1084* (2013.01); *F24D 2220/042* (2013.01); *F24F 2110/10* (2018.01); *F24F 2120/20* (2018.01)

(58) Field of Classification Search

CPC ..... F24F 11/80

See application file for complete search history.

(56) References Cited

U.S. PATENT DOCUMENTS

2012/0291468 A1 11/2012 Kato et al.

FOREIGN PATENT DOCUMENTS

| | | | |
|---|---|---|---|
| JP | 60-207845 | A | 10/1985 |
| JP | 2002-333192 | A | 11/2002 |
| JP | 2003-120945 | A | 4/2003 |

(Continued)

OTHER PUBLICATIONS

Extended European Search Report for European Application No. 20830793.4, dated Jul. 6, 2022.

(Continued)

*Primary Examiner* — Mark A Connolly

(74) *Attorney, Agent, or Firm* — BIRCH, STEWART, KOLASCH & BIRCH, LLP

(57) ABSTRACT

A control device causes an air conditioning apparatus to execute a temperature adjustment operation of causing a first temperature to approach a first target temperature at a target time point and causing a second temperature to approach a second target temperature at the target time point. The first temperature is a surface temperature of a partition portion including at least one of a floor, a wall, and a ceiling facing a target space. The second temperature is an indoor temperature of the target space.

25 Claims, 10 Drawing Sheets

(51) Int. Cl.
*F24F 120/20* (2018.01)
*F24F 110/10* (2018.01)

(56) References Cited

FOREIGN PATENT DOCUMENTS

| | | | |
|---|---|---|---|
| JP | 2004-36940 | A | 2/2004 |
| JP | 2013-204852 | A | 10/2013 |
| JP | 2015-94489 | A | 5/2015 |
| WO | WO 2011/104827 | A1 | 9/2011 |

OTHER PUBLICATIONS

English translation of International Preliminary Report on Patentability and Written Opinion of the International Searching Authority for International Application No. PCT/JP2020/025587, dated Jan. 6, 2022.
International Search Report for PCT/JP2020/025587 dated Sep. 24, 2020.
Written Opinion of the International Searching Authority for PCT/JP2020/025587 dated Sep. 24, 2020.
Title: Building Automation System in Michigan Author: David L. Johnson Jr. Published online on or about: Mar. 1, 2017 Available online: www.cooljohnson.com/Building-Automation-Systems-Michigan/Macomb-County-Michigan/Building-Automation-Confidential-Customer.html pp. 4 Evidence of publication could be found using the waybackmachine, probably.†
Title: CoolingLogic a Method to Increase HVAC System Efficiency and Decrease Energy Consumption Author: David L. Johnson Jr. Published online on or about: Sep. 24, 2016 Available online at: http://coolinglogic.com/documents/16102106_White_Paper_High_Resolution_Protected.pdf Printed copy delivered to Daikin on Dec. 27, 2016.†
Author: David Johnson Title of the publication: Building Automation Systems St Clair pp. 3 Published online on or about: Nov. 16, 2015 Available online at: www.cooljohnson.com/Building-Automation-Systems-Michigan/St-Clair-Michigan/Building-Automation-System-St-Clair-Michigan.html Evidence of publication could likely be found using the waybackmachine, if desired.†

† cited by third party

CONTROL DEVICE FOR AIR CONDITIONING APPARATUS, AIR CONDITIONING SYSTEM, CONTROL METHOD FOR AIR CONDITIONING APPARATUS, AND PROGRAM

CROSS REFERENCE TO RELATED APPLICATIONS

This application is a Continuation of PCT International Application No. PCT/JP2020/025587, filed on Jun. 29, 2020, which claims priority under 35 U.S.C. 119(a) to Patent Application No. 2019-119322, filed in Japan on Jun. 27, 2019, all of which are hereby expressly incorporated by reference into the present application.

TECHNICAL FIELD

The present disclosure relates to a control device for an air conditioning apparatus, an air conditioning system, a control method for an air conditioning apparatus, and a program.

BACKGROUND ART

Hitherto, there has been known an air conditioning apparatus that includes a sensor for detecting a room temperature and a sensor for detecting a wall temperature and that performs operation control based on the wall temperature, so as to reduce discomfort caused by radiation from a wall surface under a situation in which heat stored in a building frame has not sufficiently been processed at start of an operation (for example, PTL 1). The air conditioning apparatus according to PTL 1 is configured to operate until a room temperature becomes higher than a set temperature when a wall temperature is low at the time of heating, or until a room temperature becomes lower than a set temperature when a wall temperature is high at the time of cooling.

CITATION LIST

Patent Literature

[PTL 1] Japanese Unexamined Patent Application Publication No. 60-207845

SUMMARY

A first aspect of the present disclosure is directed to a control device (70) configured to control an air conditioning apparatus (20) configured to perform at least one of cooling and heating of a target space (100). The control device (70) is configured to cause the air conditioning apparatus (20) to execute a temperature adjustment operation of causing a first temperature (F) to approach a first target temperature (Fs) at a target time point (tg) and causing a second temperature (T) to approach a second target temperature (Ts) at the target time point (tg). The first temperature (F) is a surface temperature of a partition portion (101) including at least one of a floor, a wall, and a ceiling facing the target space (100). The second temperature (T) is an indoor temperature of the target space (100).

DESCRIPTION OF EMBODIMENTS

First Embodiment

A first embodiment will be described. An air conditioning system (10) of the present embodiment is capable of executing heating and cooling of a target space (100). The air conditioning system (10) is capable of not only causing an indoor temperature to approach a target temperature thereof but also causing a surface temperature of a floor, a wall, or the like to approach a target temperature thereof at a target time point in a case where a heating operation or a cooling operation is reserved in a state in which nobody is present in the target space (100).

Figure 1:
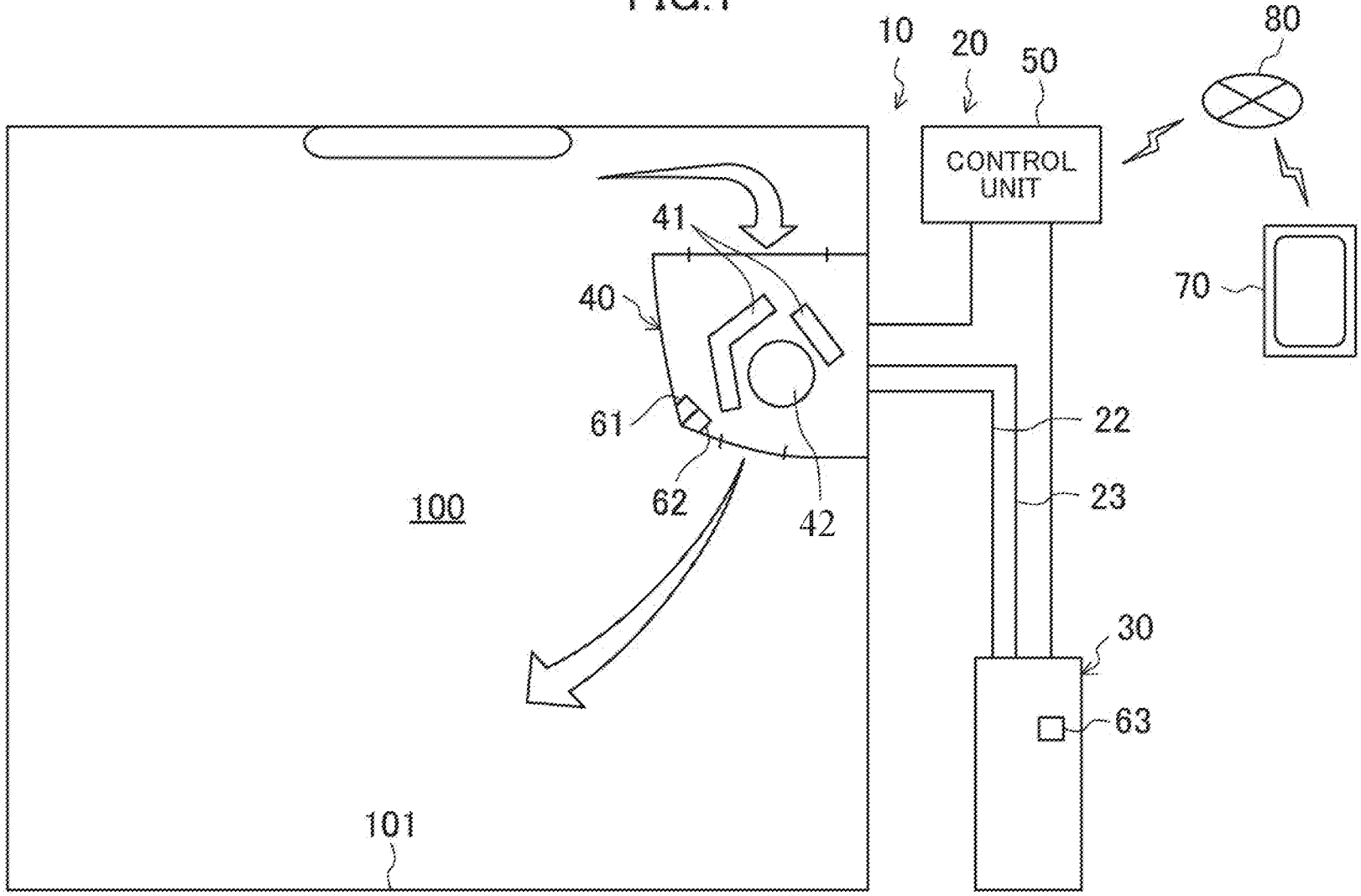
FIG. 1 is a schematic diagram schematically illustrating an air conditioning system of a first embodiment.
Figure 2:
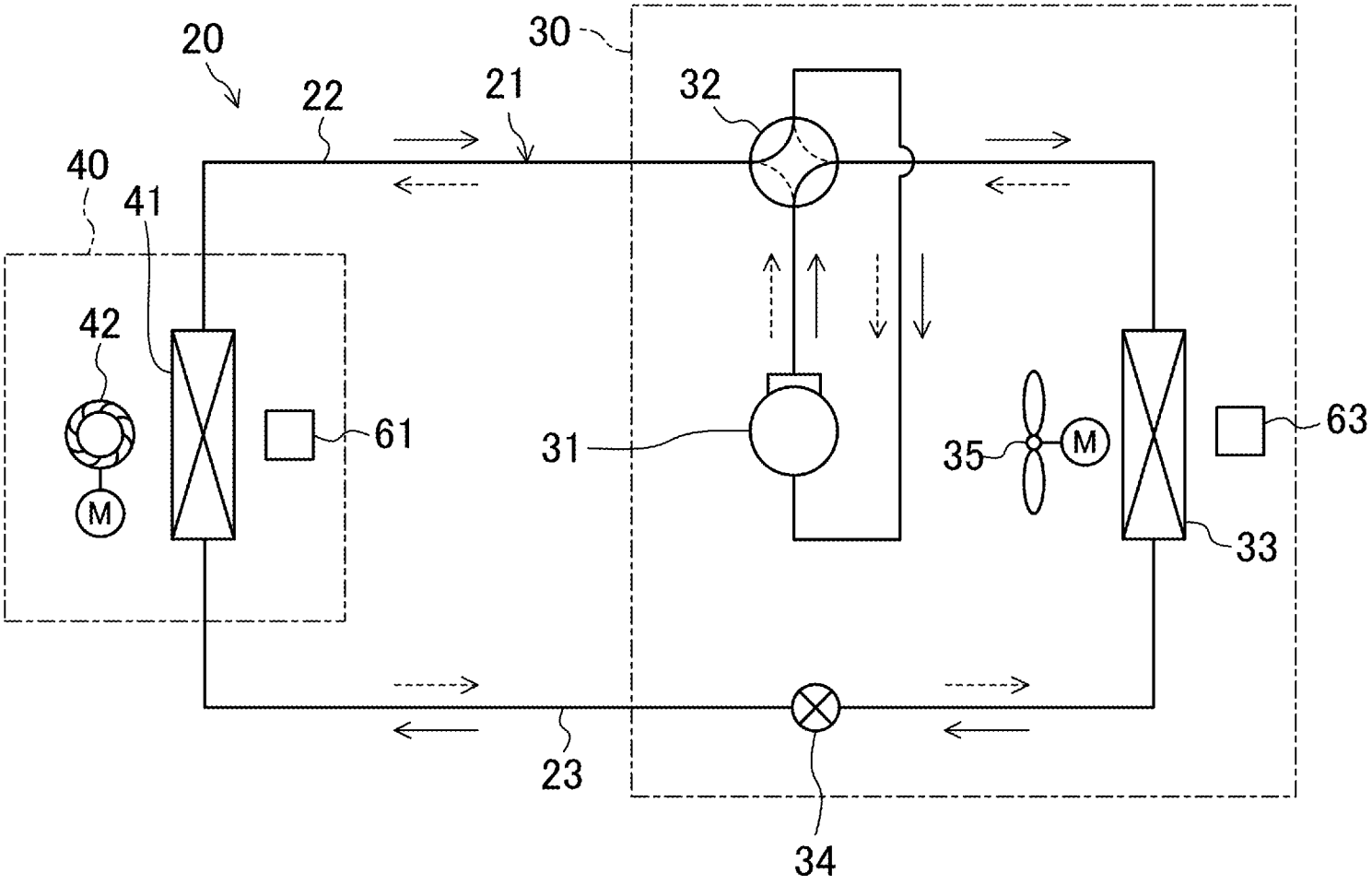
FIG. 2 is a diagram illustrating a refrigerant circuit of the air conditioning system of the first embodiment.
Figure 3:
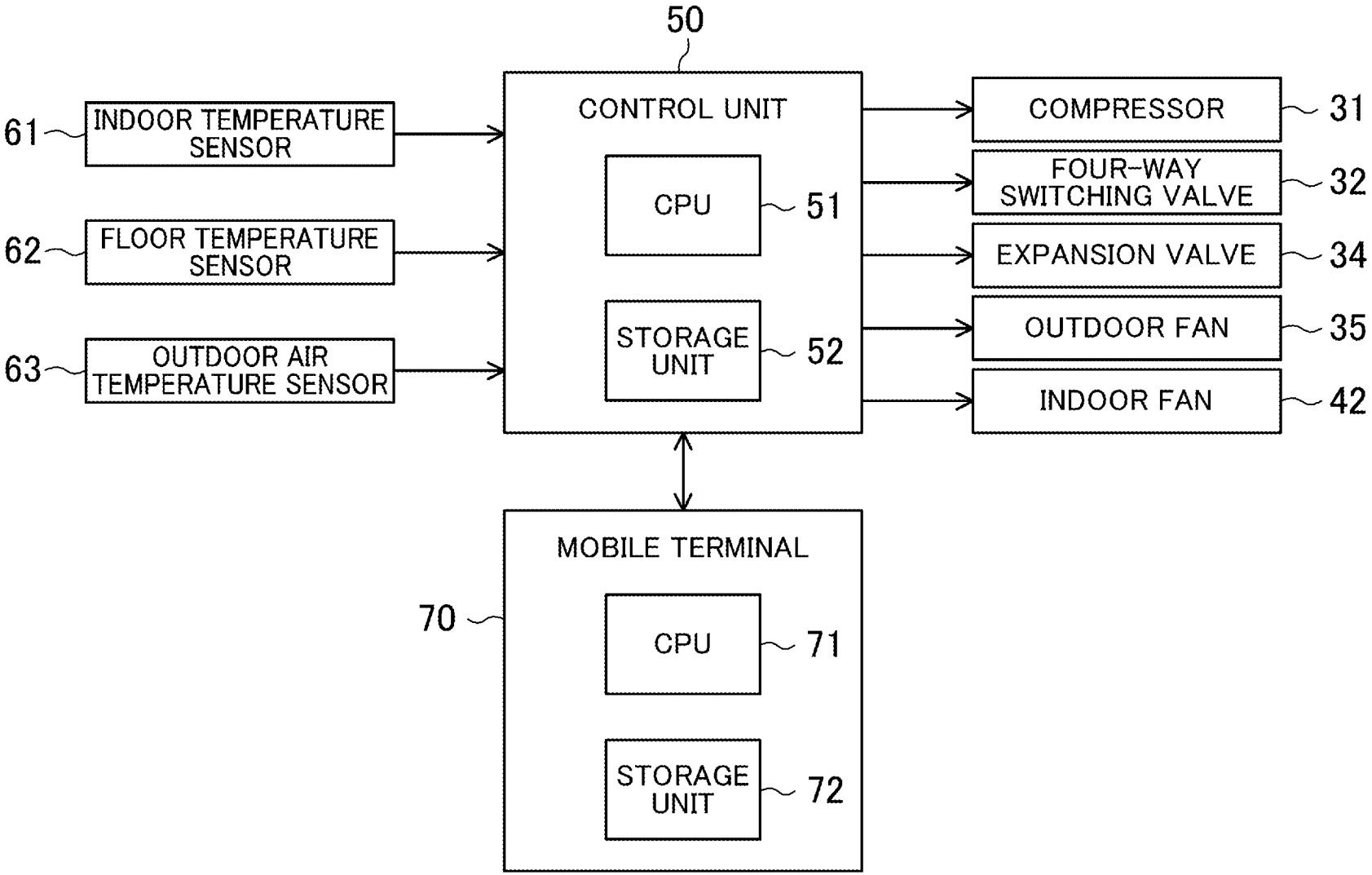
FIG. 3 is a block diagram illustrating a configuration of the air conditioning system of the first embodiment.

As illustrated in FIG. 1 to FIG. 3, the air conditioning system (10) includes an air conditioning apparatus (20) and a mobile terminal (70). The mobile terminal (70) is an example of a computer and constitutes a control device. A floor (101) facing the target space (100) constitutes a partition portion. Alternatively, a ceiling or wall facing the target space (100) may constitute a partition portion, or any combination of the floor (101), the ceiling, and the wall may constitute a partition portion.

The air conditioning apparatus (20) includes an outdoor unit (30) installed outside the target space (100), an indoor unit (40) installed in the target space (100), and a control unit (50).

<Outdoor Unit and Indoor Unit>

The outdoor unit (30) and the indoor unit (40) are connected to each other through connection pipes (22, 23), and constitute a refrigerant circuit (21) illustrated in FIG. 2. In the refrigerant circuit (21), refrigerant supplied thereto circulates, and thus vapor compression refrigeration cycle is performed. The refrigerant may be, for example, an R32 refrigerant.

The outdoor unit (30) is installed outdoors, for example, on a roof of a building, on the ground beside the building, or on a balcony. The outdoor unit (30) includes a compressor (31), a four-way switching valve (32), an outdoor heat exchanger (33), an expansion valve (34), and an outdoor fan (35). The compressor (31), the four-way switching valve (32), the outdoor heat exchanger (33), and the expansion valve (34) are connected in this order through a refrigerant pipe.

The compressor (31) compresses sucked refrigerant and discharges the compressed refrigerant. The compressor (31) is of a capacity-variable inverter type, for example. The compressor (31) is, for example, a rotary compressor. The outdoor fan (35) is installed near the outdoor heat exchanger (33). The outdoor fan (35) is constituted by, for example, a propeller fan. The outdoor fan (35) transfers outdoor air and causes the outdoor air to pass through the outdoor heat exchanger (33).

The outdoor heat exchanger (33) exchanges heat between the outdoor air transferred by the outdoor fan (35) and the refrigerant flowing therein. The outdoor heat exchanger (33) is constituted by, for example, a fin-and-tube heat exchanger. The expansion valve (34) is a control valve whose opening degree is variable. The expansion valve (34) decompresses the refrigerant flowing therein. The expansion valve (34) is constituted by, for example, an electronic expansion valve.

The four-way switching valve (32) switches a flow path of the refrigerant in the refrigerant circuit (21) between a first state (a state indicated by solid lines in FIG. 2) and a second state (a state indicated by broken lines in FIG. 2). The four-way switching valve (32) in the first state causes a discharge port of the compressor (31) and the outdoor heat exchanger (33) to communicate with each other, and also causes a suction port of the compressor (31) and an indoor heat exchanger (41) to communicate with each other. The four-way switching valve (32) in the second state causes the discharge port of the compressor (31) and the indoor heat exchanger (41) to communicate with each other, and also causes the suction port of the compressor (31) and the outdoor heat exchanger (33) to communicate with each other.

The indoor unit (40) is attached to, for example, a wall surface or ceiling in a room. The indoor unit (40) illustrated in FIG. 1 is a wall-mounted unit attached to a wall surface. The indoor unit (40) includes the indoor heat exchanger (41) and an indoor fan (42). The indoor fan (42) is installed near the indoor heat exchanger (41).

The indoor fan (42) is constituted by, for example, a cross-flow fan. The indoor fan (42) transfers indoor air and causes the indoor air to pass through the indoor heat exchanger (41). The indoor heat exchanger (41) exchanges heat between the indoor air transferred by the indoor fan (42) and the refrigerant flowing therein. The indoor heat exchanger (41) is constituted by, for example, a fin-and-tube heat exchanger.

In the refrigerant circuit (21), when the four-way switching valve (32) is in the first state, a refrigeration cycle is performed in which the outdoor heat exchanger (33) functions as a condenser or a radiator and the indoor heat exchanger (41) functions as an evaporator. On the other hand, in the refrigerant circuit (21), when the four-way switching valve (32) is in the second state, a refrigeration cycle is performed in which the outdoor heat exchanger (33) functions as an evaporator and the indoor heat exchanger (41) functions as a condenser or a radiator.

<Sensors>

The air conditioning system (10) further includes an indoor temperature sensor (61), a floor temperature sensor (62), and an outdoor air temperature sensor (63). These sensors (61 to 63) are connected to the control unit (50) in a wired or wireless manner. These sensors (61 to 63) each output a detection signal to the control unit (50).

The indoor temperature sensor (61) and the floor temperature sensor (62) are provided in, for example, the indoor unit (40). The indoor temperature sensor (61) detects a temperature of indoor air sucked into the indoor unit (40), thereby detecting a second temperature (T), which is an indoor temperature of the target space (100). The floor temperature sensor (62) detects heat radiated from the floor (101), thereby detecting a first temperature (F), which is a surface temperature of the floor (101).

The outdoor air temperature sensor (63) is provided in, for example, the outdoor unit (30). The outdoor air temperature sensor (63) detects a temperature of outdoor air (outdoor air temperature (Tout)) sucked into the outdoor unit (30).

<Control Unit>

The control unit (50) is a controller including a known microcomputer. As illustrated in FIG. 3, the control unit (50) includes a central processing unit (CPU) (51) that executes a program, and a storage unit (52) that stores various programs executed by the CPU (51) and data. The storage unit (52) is constituted by a read only memory (ROM), a random access memory (RAM), or the like. The control unit (50) is built in, for example, the indoor unit (40).

The control unit (50) calculates a control amount for the outdoor unit (30) and the indoor unit (40), based on detection signals of the indoor temperature sensor (61), the floor temperature sensor (62), and the outdoor air temperature sensor (63), and an operation signal from the mobile terminal (70) or a remote controller (not illustrated). The control unit (50) outputs a control signal related to the calculated control amount to the outdoor unit (30) and the indoor unit (40).

<Mobile Terminal>

The mobile terminal (70) is used by a user to operate the air conditioning apparatus (20). The mobile terminal (70) is constituted by, for example, a smartphone. The mobile terminal (70), which is a computer, has installed therein a program for causing the mobile terminal (70) to function as a control device. By executing the installed program, the mobile terminal (70) performs processing for functioning as a control device that controls the air conditioning apparatus (20).

The mobile terminal (70) is capable of wirelessly communicating with the control unit (50) of the air conditioning apparatus (20) via a network (80). As illustrated in FIG. 3, the mobile terminal (70) includes a CPU (71) and a storage unit (72) that stores various programs executed by the CPU (71) and data. The storage unit (72) is constituted by a ROM, a RAM, or the like. The storage unit (72) stores learning data to be used to execute a temperature adjustment operation (preliminary heating operation, preliminary cooling operation) described below.

—Operation of Air Conditioning System—

The air conditioning system (10) selectively executes a heating operation, a cooling operation, a preliminary heating operation, and a preliminary cooling operation in accordance with a user operation. The preliminary heating operation is a special heating operation and is an example of a temperature adjustment operation. The preliminary cooling operation is a special cooling operation and is an example of a temperature adjustment operation.

<Heating Operation>

In a heating operation, the four-way switching valve (32) is in the second state. Refrigerant compressed by the compressor (31) flows through the indoor heat exchanger (41). In the indoor heat exchanger (41), the refrigerant radiates heat to indoor air to condense. The indoor air heated by the indoor heat exchanger (41) is blown to the target space (100) by the indoor fan (42). The condensed refrigerant is decompressed by the expansion valve (34) and then evaporates in the outdoor heat exchanger (33). The evaporated refrigerant is sucked into the compressor (31).

In a heating operation, the air conditioning apparatus (20) performs an air heating operation. The air heating operation is an operation of blowing heated air to the target space (100). In the heating operation, the air conditioning apparatus (20) may temporarily suspend the air heating operation. For example, when a measured value of the indoor temperature sensor (61) increases to a set temperature during the heating operation, the air conditioning apparatus (20) temporarily suspends the air heating operation.

<Cooling Operation>

In a cooling operation, the four-way switching valve (32) is in the first state. Refrigerant compressed by the compressor (31) radiates heat (condenses) in the outdoor heat exchanger (33). The refrigerant that has radiated heat is decompressed by the expansion valve (34) and then flows through the indoor heat exchanger (41). In the indoor heat exchanger (41), the refrigerant absorbs heat from indoor air to evaporate. The indoor air cooled by the indoor heat exchanger (41) is blown to the target space (100) by the indoor fan (42). The evaporated refrigerant is sucked into the compressor (31).

In a cooling operation, the air conditioning apparatus (20) performs an air cooling operation. The air cooling operation is an operation of blowing cooled air to the target space (100). In the cooling operation, the air conditioning apparatus (20) may temporarily suspend the air cooling operation. For example, when a measured value of the indoor temperature sensor (61) decreases to a set temperature during the cooling operation, the air conditioning apparatus (20) temporarily suspends the air cooling operation.

<Preliminary Heating Operation>

A preliminary heating operation is a special heating operation for causing a first temperature (F), which is a surface temperature of the floor (101), and a second temperature (T), which is an indoor temperature of the target space (100), to approach respective target temperatures (Fs, Ts) at a target time point (tg). The preliminary heating operation is executed in response to a predetermined instruction operation performed by a user who is not present in the target space (100) by using the mobile terminal (70).

—Operation of Preliminary Heating Operation—

Figure 4:
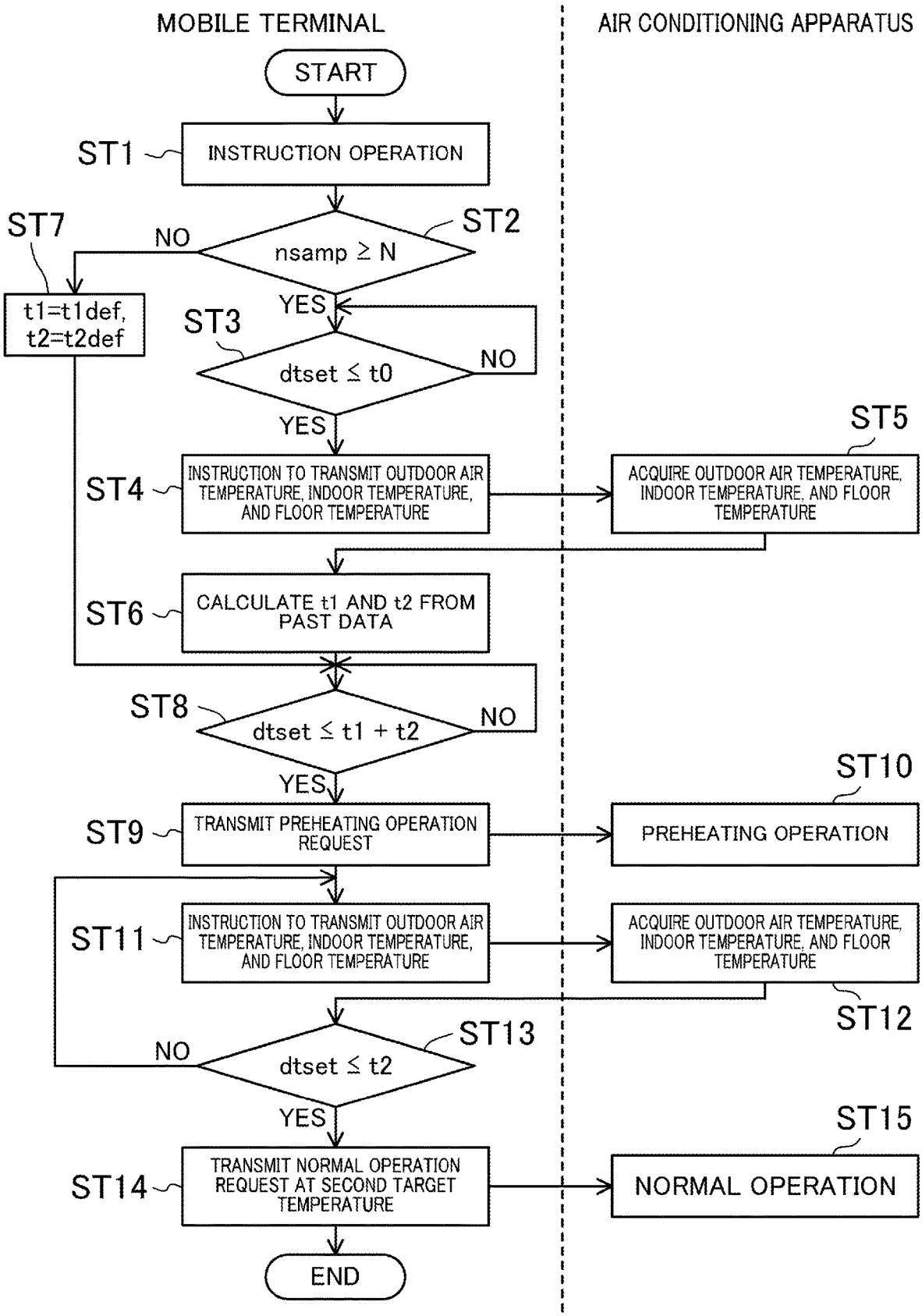
FIG. 4 is a flowchart illustrating an operation of the air conditioning system of the first embodiment in a preliminary heating operation or a preliminary cooling operation.
Figure 5:
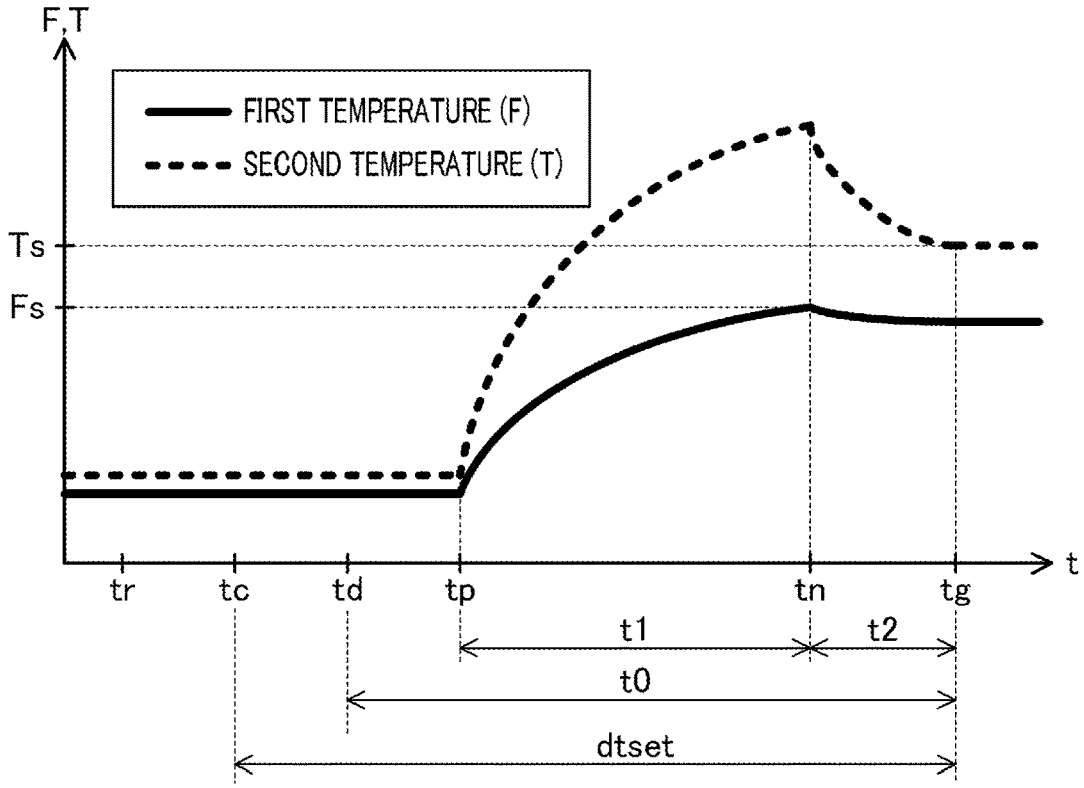
FIG. 5 is a graph illustrating changes in temperatures in a preliminary heating operation of the air conditioning system of the first embodiment.

An operation of a preliminary heating operation will be described in detail with reference to the flowchart in FIG. 4 and the graph in FIG. 5. In FIG. 4, an operation related to the mobile terminal (70) is illustrated on the left side of the broken line, and an operation related to the air conditioning apparatus (20) is illustrated on the right side of the broken line. In the graph in FIG. 5, the horizontal axis represents time, and the vertical axis represents first temperature (F) and second temperature (T).

First, in step ST1, a user performs a predetermined instruction operation by using the mobile terminal (70) at a certain time point (tr). The user performs the instruction operation, for example, at a time point of leaving the target space (100) or at a time point before returning to the target space (100) from the outside.

In this instruction operation, the user designates a second target temperature (Ts) and a target time point (tg). The second target temperature (Ts) is a target temperature that the second temperature (T) is to reach. The target time point (tg) is a time point (for example, time) at which the second temperature (T) is to reach the second target temperature (Ts). Alternatively, the second target temperature (Ts) and the target time point (tg) may be automatically set by the mobile terminal (70).

Subsequently, the mobile terminal (70) performs a process of step ST2. In the process of step ST2, the mobile terminal (70) determines whether the number of pieces of past data (nsamp) of the first temperature (F) and the second temperature (T) of a preliminary heating operation is larger than or equal to a predetermined number (N). The number of pieces of past data (nsamp) increases by one every time a preliminary heating operation is performed. The predetermined number (N) is set to 1, for example, but may be set to 2 or more. If the number of pieces of past data (nsamp) is larger than or equal to the predetermined number (N), the mobile terminal (70) performs a process of step ST3. Otherwise, the mobile terminal (70) performs a process of step ST7.

In the process of step ST3, the mobile terminal (70) determines whether a time (dtset) from a current time point (tc) to the target time point (tg) is shorter than or equal to a time (t0) from a decision time point (td) of deciding a starting time point (tp) to the target time point (tg). The starting time point (tp) is a time point of starting the preliminary heating operation. The decision time point (td) is a time point of deciding the starting time point (tp). If the former time (dtset) is shorter than or equal to the latter time (t0), the mobile terminal (70) performs a process of step ST4. Otherwise, the mobile terminal (70) repeats the process of step ST3.

In the process of step ST4, the mobile terminal (70) transmits, to the air conditioning apparatus (20) (specifically, the control unit (50) of the air conditioning apparatus (20)), an instruction signal indicating a request for transmitting signals related to the first temperature (F), the second temperature (T), and the outdoor air temperature (Tout). The air conditioning apparatus (20) that has received the instruction signal performs a process of step ST5.

In the process of step ST5, the air conditioning apparatus (20) transmits, to the mobile terminal (70), signals related to the first temperature (F), the second temperature (T), and the outdoor air temperature (Tout) acquired by the floor temperature sensor (62), the indoor temperature sensor (61), and the outdoor air temperature sensor (63), respectively. The mobile terminal (70) that has received the signals performs a process of step ST6.

In the process of step ST6, the mobile terminal (70) calculates a first execution time (t1) and a second execution time (t2), based on past data of the first temperature (F) and the second temperature (T) of a preliminary heating operation. The first execution time (t1) is a time during which a preheating operation (first operation) is executed in the preliminary heating operation. The second execution time (t2) is a time during which a normal operation (second operation) is executed in the preliminary heating operation.

Figure 6:
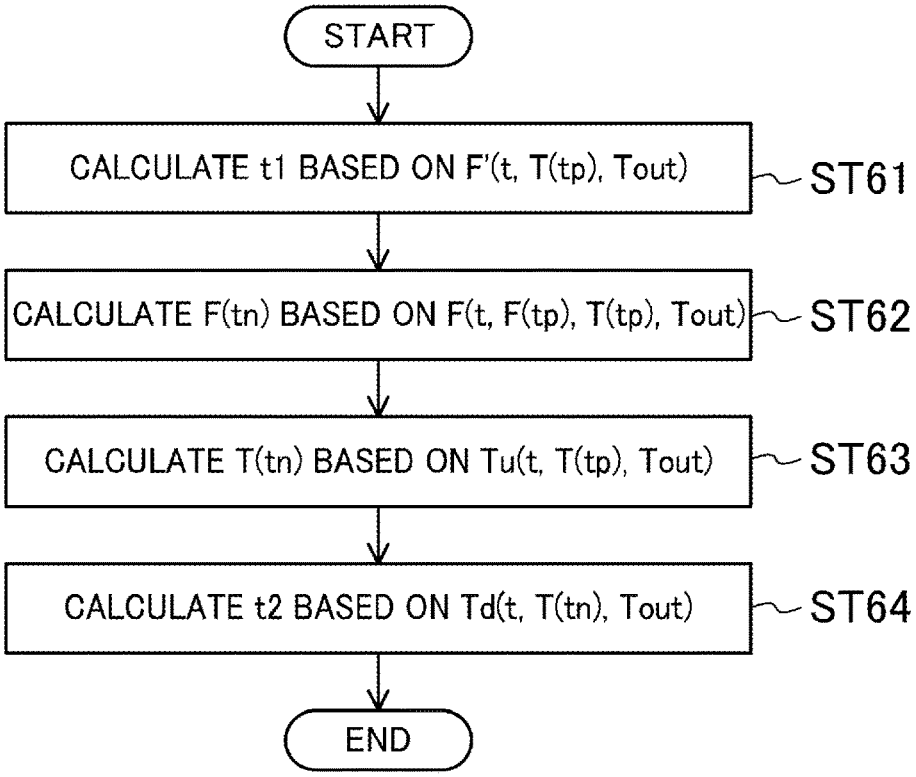
FIG. 6 is a flowchart illustrating a procedure of calculating individual execution times by a mobile terminal (control device) of the first embodiment.

Now, a method for calculating the first execution time (t1) and the second execution time (t2) will be described in detail with reference to the flowchart in FIG. 6.

First, in a process of step ST61, the mobile terminal (70) calculates, based on an upward-gradient prediction formula F'(t, T(tp), Tout) of the first temperature (F), an estimated value of a time that is taken until a change rate of the first temperature (F) becomes lower than or equal to a predetermined value (for example, a change in temperature per minute is 0.1° C.). The upward-gradient prediction formula F'(t, T (tp), Tout) of the first temperature (F) is a mathematical expression in which an operation time (t), a second temperature T(tp) at start of a preheating operation, and an outdoor air temperature (Tout) are variables, and is obtained from past operation history data. The mobile terminal (70) stores the calculated estimated value of the time as the first execution time (t1) in the storage unit (72).

Subsequently, the mobile terminal (70) performs a process of step ST62. In the process of step ST62, the mobile terminal (70) calculates, based on a prediction formula F(t, F(tp), T(tp), Tout) of the first temperature (F), an estimated value of a first temperature F(tn) at a time point (tn) at which the foregoing time (first execution time (t1)) has elapsed from the start of the preheating operation. The prediction formula F(t, F(tp), T(tp), Tout) of the first temperature (F) is a mathematical expression in which an operation time (t), a first temperature F(tp) and a second temperature T(tp) at start of a preheating operation, and an outdoor air temperature (Tout) are variables, and is obtained from past operation history data. The mobile terminal (70) stores the calculated estimated value of the first temperature F(tn) as the first target temperature (Fs) in the storage unit (72). The first target temperature (Fs) is a target temperature that the first temperature (F) is to reach.

Subsequently, the mobile terminal (70) performs a process of step ST63. In the process of step ST63, the mobile terminal (70) calculates, based on an upward prediction formula Tu(t, T(tp), Tout) of the second temperature (T), an estimated value of a second temperature T(tn) at a time point (tn) at which the foregoing time (first execution time (t1)) has elapsed from the start of the preheating operation. The upward prediction formula Tu(t, T(tp), Tout) of the second temperature (T) is a mathematical expression in which an operation time (t), a second temperature T(tp) at start of a preheating operation, and an outdoor air temperature (Tout) are variables, and is obtained from past operation history data. The mobile terminal (70) stores the calculated estimated value of the second temperature T(tn) in the storage unit (72).

Subsequently, the mobile terminal (70) performs a process of step ST64. In the process of step ST64, the mobile terminal (70) calculates, based on a downward prediction formula Td(t, T(tn), Tout) of the second temperature (T), an estimated value of a time that is taken from when the operation of the air conditioning apparatus (20) has switched from a preheating operation to a normal operation to when the second temperature (T) decreases to the second target temperature (Ts). The downward prediction formula Td(t, T(tn), Tout) of the second temperature (T) is a mathematical expression in which an operation time (t), a second temperature T(tn) at a time point (tn) at which the first execution time (t1) has elapsed from start of the preheating operation, and an outdoor air temperature (Tout) are variables, and is obtained from past operation history data. The mobile terminal (70) stores the calculated estimated value of the time as the second execution time (t2) in the storage unit (72).

The description of the method for calculating the first execution time (t1) and the second execution time (t2) ends now.

In the process of step ST7, the mobile terminal (70) sets the first execution time (t1) and the second execution time (t2) to preset values (t1def, t2def), respectively. The set value t1def of the first execution time (t1) is, for example, 30 minutes. The set value t2def of the second execution time (t2) is, for example, 10 minutes.

After the process of step ST6 or step ST7 ends, the mobile terminal (70) performs a process of step ST8. In the process of step ST8, the mobile terminal (70) determines whether the time (dtset) from the current time point (tc) to the target time point (tg) is shorter than or equal to a total execution time (ttot). The total execution time (ttot) is a sum of the first execution time (t1) and the second execution time (t2) (ttot=t1+t2). If the former time (dtset) is shorter than or equal to the total execution time (ttot), the mobile terminal (70) performs a process of step ST9. Otherwise, the mobile terminal (70) repeats the process of step ST8.

In the process of step ST9, the mobile terminal (70) transmits, to the air conditioning apparatus (20) (specifically, the control unit (50) of the air conditioning apparatus (20)), an instruction signal indicating a request for starting a preheating operation. The air conditioning apparatus (20) that has received the instruction signal starts a preheating operation in a process of step ST10. The time point at which the air conditioning apparatus (20) starts a preheating operation is a preheating operation starting time point (tp) (first operation starting time point (tp)). The air conditioning apparatus (20) performs the preheating operation over the first execution time (t1) from the preheating operation starting time point (tp).

In this preheating operation, the air conditioning apparatus (20) performs an air heating operation of blowing heated air to the target space (100). In this preheating operation, the heating capacity of the air conditioning apparatus (20) is set to a maximum. Specifically, the rotational speeds of the compressor (31), the outdoor fan (35), and the indoor fan (42) are set to respective maximum values.

After the process of step ST9 ends, the mobile terminal (70) performs a process of step ST11. In the process of step ST11, the mobile terminal (70) transmits, to the air conditioning apparatus (20) (specifically, the control unit (50) of the air conditioning apparatus (20)), an instruction signal indicating a request for transmitting signals related to the first temperature (F), the second temperature (T), and the outdoor air temperature (Tout). The air conditioning apparatus (20) that has received the instruction signal performs a process of step ST12.

In the process of step ST12, the air conditioning apparatus (20) transmits, to the mobile terminal (70), signals related to the first temperature (F), the second temperature (T), and the outdoor air temperature (Tout) acquired by the floor temperature sensor (62), the indoor temperature sensor (61), and the outdoor air temperature sensor (63), respectively. The mobile terminal (70) that has received the signals performs a process of step ST13.

In the process of step ST13, the mobile terminal (70) determines whether the time (dtset) from the current time point (tc) to the target time point (tg) is shorter than or equal to the second execution time (t2). If the former time (dtset) is shorter than or equal to the second execution time (t2), the mobile terminal (70) performs a process of step ST14. Otherwise, the mobile terminal (70) performs the process of step ST11 again.

Here, the processes of steps ST11 to 14 are repeatedly performed, and thus the mobile terminal (70) acquires data about the first temperature (F), the second temperature (T), and the outdoor air temperature (Tout) in the preheating operation. The mobile terminal (70) records the acquired data in the storage unit (72), and uses the acquired data as past data for updating learning data that is to be used in a preliminary heating operation next time or thereafter.

In a process of step ST14, the mobile terminal (70) transmits, to the air conditioning apparatus (20) (specifically, the control unit (50) of the air conditioning apparatus (20)), an instruction signal indicating a request for starting a normal operation. The air conditioning apparatus (20) that has received the instruction signal ends the preheating operation and starts a normal operation in a process of step ST15. The time point at which the air conditioning apparatus (20) starts a normal operation is a normal operation starting time point (tn) (second operation starting time point (tn)).

In this normal operation, the control unit (50) of the air conditioning apparatus (20) adjusts the heating capacity of the air conditioning apparatus (20) so that a measured value of the indoor temperature sensor (61) becomes the second target temperature (Ts). Specifically, the control unit (50) adjusts the rotational speeds of the compressor (31), the outdoor fan (35), and the indoor fan (42) so that a measured value of the indoor temperature sensor (61) becomes the second target temperature (Ts).

—Changes in Temperatures in Preliminary Heating Operation—

Changes in the first temperature (F) and the second temperature (T) in a preliminary heating operation will be described with reference to the graph in FIG. 5. In the graph in FIG. 5, the first temperature (F) is indicated by a solid line, and the second temperature (T) is indicated by a broken line.

As described above, a preheating operation in the preliminary heating operation is performed over the first execution time (t1). During the preheating operation, the first temperature (F) (the surface temperature of the floor (101)) increases less steeply, whereas the second temperature (T) (the indoor temperature of the target space (100)) increases more steeply. The second temperature (T) becomes higher than the second target temperature (Ts) in the middle of the preheating operation. However, the preheating operation (the air heating operation of the air conditioning apparatus (20)) is continued. On the other hand, the first temperature (F) converges to the first target temperature (Fs) at an ending time point (tn) of the preheating operation.

The preheating operation is followed by a normal operation, which is performed over the second execution time (t2), in the preliminary heating operation. In the normal operation, the heating capacity of the air conditioning apparatus (20) is lower than in the preheating operation because the second temperature (T) is higher than the second target temperature (Ts). In the example illustrated in FIG. 5, the second temperature (T) is higher than the second target temperature (Ts) at the ending time point (tn) of the preheating operation, and thus the air conditioning apparatus (20) that performs the normal operation is in a state in which the air heating operation is suspended (a so-called thermo-off state).

During the normal operation, the first temperature (F) slightly decreases, whereas the second temperature (T) decreases relatively significantly. The second temperature (T) converges to the second target temperature (Ts) at the ending time point (tg) of the normal operation (the ending time point (tg) of the preliminary heating operation).

<Preliminary Cooling Operation>

A preliminary cooling operation is a special cooling operation for causing the first temperature (F) and the second temperature (T) to approach the respective target temperatures (Fs, Ts) at the target time point (tg). The preliminary cooling operation is executed in response to a predetermined instruction operation performed by a user who is not present in the target space (100) by using the mobile terminal (70).

—Operation of Preliminary Cooling Operation—

The operation of the preliminary cooling operation is substantially the same as the operation of the above-described preliminary heating operation, and thus the detailed description thereof is omitted. A different point is that, in the preliminary cooling operation, a precooling operation (first operation) is performed instead of a preheating operation over the first execution time (t1).

In the precooling operation, the air conditioning apparatus (20) performs an air cooling operation of blowing cooled air to the target space (100). In this precooling operation, the cooling capacity of the air conditioning apparatus (20) is set to a maximum. Specifically, the rotational speeds of the compressor (31), the outdoor fan (35), and the indoor fan (42) are set to respective maximum values.

—Changes in Temperatures in Preliminary Cooling Operation—

Figure 7:
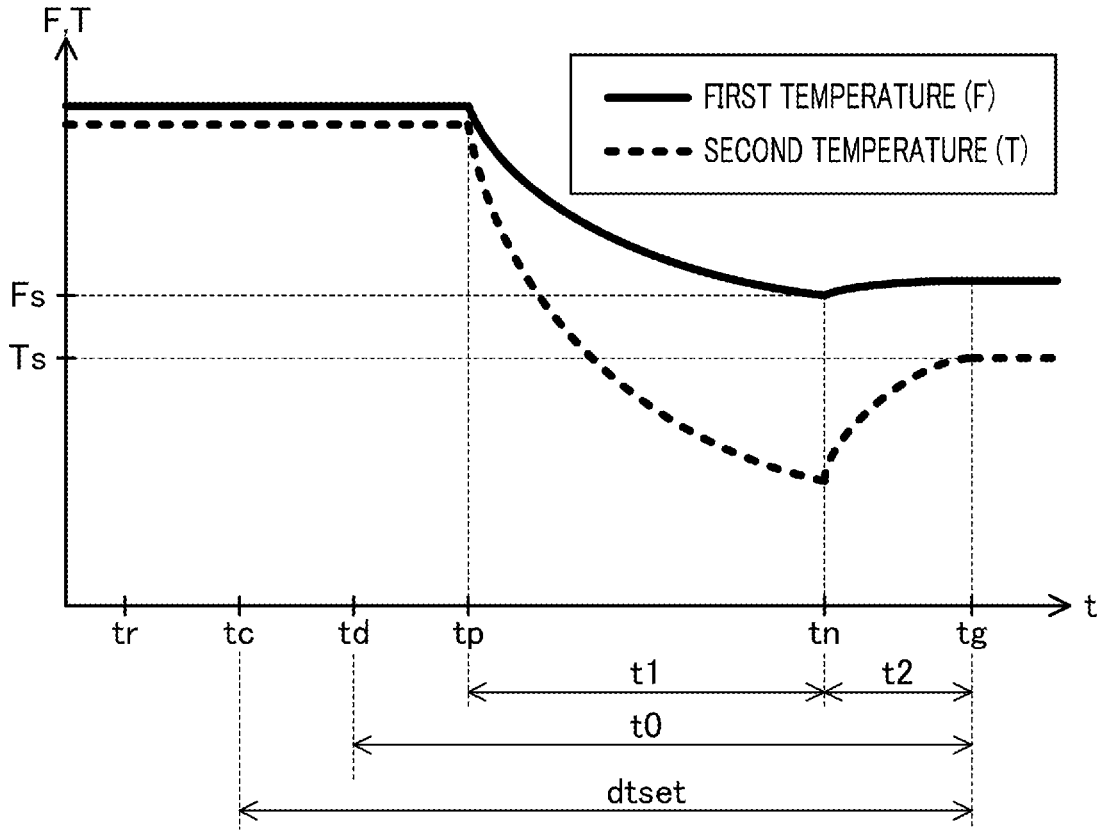
FIG. 7 is a graph illustrating changes in temperatures in a preliminary cooling operation of the air conditioning system of the first embodiment.

Changes in the first temperature (F) and the second temperature (T) in a preliminary cooling operation will be described with reference to the graph in FIG. 7. In the graph in FIG. 7, the first temperature (F) is indicated by a solid line, and the second temperature (T) is indicated by a broken line.

As described above, a precooling operation in the preliminary cooling operation is performed over the first execution time (t1). During the precooling operation, the first temperature (F) (the surface temperature of the floor (101)) decreases less steeply, whereas the second temperature (T) (the indoor temperature of the target space (100)) decreases more steeply. The second temperature (T) becomes lower than the second target temperature (Ts) in the middle of the precooling operation. However, the precooling operation (the air cooling operation of the air conditioning apparatus (20)) is continued. On the other hand, the first temperature (F) converges to the first target temperature (Fs) at an ending time point (tn) of the precooling operation.

The precooling operation is followed by a normal operation, which is performed over the second execution time (t2), in the preliminary cooling operation. In the normal operation, the cooling capacity of the air conditioning apparatus (20) is lower than in the precooling operation because the second temperature (T) is lower than the second target temperature (Ts). In the example illustrated in FIG. 7, the second temperature (T) is lower than the second target temperature (Ts) at the ending time point (tn) of the precooling operation, and thus the air conditioning apparatus (20) that performs the normal operation is in a state in which the air cooling operation is suspended (a so-called thermo-off state).

During the normal operation, the first temperature (F) slightly increases, whereas the second temperature (T) increases relatively significantly. The second temperature (T) converges to the second target temperature (Ts) at the ending time point (tg) of the normal operation (the ending time point (tg) of the preliminary cooling operation).

Advantage (1) of First Embodiment

The control device (70) (mobile terminal (70)) of the present embodiment is configured to control the air conditioning apparatus (20) configured to perform at least one of cooling and heating of the target space (100), and is configured to cause the air conditioning apparatus (20) to execute a temperature adjustment operation (preliminary heating operation, preliminary cooling operation) of causing a first temperature (F) to approach a first target temperature (Fs) at a target time point (tg) and causing a second temperature (T) to approach a second target temperature (Ts) at the target time point (tg). The first temperature (F) is a surface temperature of the floor (101) facing the target space (100). The second temperature (T) is an indoor temperature of the target space (100).

Accordingly, it is possible to cause the first temperature (F), which is a surface temperature of the floor (101), and the second temperature (T), which is an indoor temperature of the target space (100), to approach the respective target temperatures (Fs, Ts) at the target time point (tg).

Advantage (2) of First Embodiment

The control device (70) of the present embodiment is configured to cause the air conditioning apparatus (20) to execute a first operation (preheating operation, precooling operation) of converging the first temperature (F) to the first target temperature (Fs) and a second operation (normal operation) of converging the second temperature (T) to the second target temperature (Ts).

The control device (70) of the present embodiment is configured to cause the air conditioning apparatus (20) to execute, in the temperature adjustment operation, the first operation and the second operation in an order of the first operation and the second operation.

Accordingly, it is possible to converge the first temperature (F) to the first target temperature (Fs) in the first operation and converge the second temperature (T) to the second target temperature (Ts) in the second operation.

Advantage (3) of First Embodiment

The control device (70) of the present embodiment is configured to, when the air conditioning apparatus (20) heats the target space (100), in the first operation, cause the air conditioning apparatus (20) to continue an air heating operation even if the second temperature (T) becomes higher than a predetermined value that is higher than or equal to the second target temperature (Ts), and in the second operation, cause a heating capacity of the air conditioning apparatus (20) to be lower than in the first operation if the second temperature (T) is higher than the predetermined value (in this example, the second target temperature (Ts)) that is higher than or equal to the second target temperature (Ts).

In a normal heating operation, the air conditioning apparatus (20) temporarily suspends an air heating operation when the second temperature (T) as an indoor temperature becomes higher than the second target temperature (Ts). In contrast, in the present embodiment, the air conditioning apparatus (20) continues the air heating operation even if the second temperature (T) becomes higher than the second target temperature (Ts). Accordingly, it is possible to quickly increase the first temperature (F) in the first operation of a preliminary heating operation. Furthermore, it is possible to quickly cause the second temperature (T) to approach the second target temperature (Ts) in the second operation of the preliminary heating operation.

Advantage (4) of First Embodiment

The control device (70) of the present embodiment is configured to, when the air conditioning apparatus (20) cools the target space (100), in the first operation, cause the air conditioning apparatus (20) to continue an air cooling operation even if the second temperature (T) becomes lower than a predetermined value that is lower than or equal to the second target temperature (Ts), and in the second operation, cause a cooling capacity of the air conditioning apparatus (20) to be lower than in the first operation if the second temperature (T) is lower than the predetermined value (in this example, the second target temperature (Ts)) that is lower than or equal to the second target temperature (Ts).

In a normal cooling operation, the air conditioning apparatus (20) temporarily suspends an air cooling operation when the second temperature (T) as an indoor temperature becomes lower than the second target temperature (Ts). In contrast, in the present embodiment, the air conditioning apparatus (20) continues the air cooling operation even if the second temperature (T) becomes lower than the second target temperature (Ts). Accordingly, it is possible to quickly decrease the first temperature (F) in the first operation of a preliminary cooling operation. Furthermore, it is possible to quickly cause the second temperature (T) to approach the second target temperature (Ts) in the second operation of the preliminary cooling operation.

Advantage (5) of First Embodiment

The control device (70) of the present embodiment is configured to, before the air conditioning apparatus (20) starts operating, estimate a first execution time (t1) of the first operation and a second execution time (t2) of the second operation, based on past learning data, and cause the air conditioning apparatus (20) to start the first operation at a time point that is a total execution time (ttot) or more before the target time point (tg), the total execution time (ttot) being a sum of the first execution time (t1) and the second execution time (t2).

The air conditioning apparatus (20) is caused to start the first operation at a time point that is the total execution time (ttot) or more before the target time point (tg), and thus the first temperature (F) and the second temperature (T) are more likely to approach the respective target temperatures (Fs, Ts) at the target time point (tg).

Advantage (6) of First Embodiment

The control device (70) of the present embodiment is configured to, before the air conditioning apparatus (20) starts operating, estimate the first execution time (t1) from when the first operation to be presently executed starts to when the first temperature (F) converges to the first target temperature (Fs), based on the learning data including the first temperature (F), an outdoor air temperature (Tout), and the second temperature (T) in a past first operation, and on the first temperature (F), an outdoor air temperature (Tout), and the second temperature (T) that are currently obtained.

Thus, it is possible to estimate the first execution time (t1) of the present first operation by using the learning data including the individual parameters of the past first operation.

Advantage (7) of First Embodiment

In the control device (70) of the present embodiment, the first target temperature (Fs) is a temperature at which a change rate of the first temperature (F) is estimated to become lower than or equal to a predetermined value. Accordingly, it is possible to avoid unnecessarily executing the first operation for a long time.

Advantage (8) of First Embodiment

The control device (70) of the present embodiment is configured to, before the air conditioning apparatus (20) starts operating, estimate a second execution time (t2) from when the second operation to be presently executed starts to when the second temperature (T) converges to the second target temperature (Ts), based on learning data including an outdoor air temperature (Tout) and the second temperature (T) in a past first operation, on the second temperature (T) that is estimated from the learning data and that is to be obtained at start of the second operation to be presently executed, and on a present outdoor air temperature (Tout).

Thus, it is possible to estimate the second execution time (t2) of the present second operation by using the learning data including the individual parameters of the past second operation.

Advantage (9) of First Embodiment

The control method of the present embodiment is a control method for the air conditioning apparatus (20) configured to perform at least one of cooling and heating of the target space (100), and includes causing the air conditioning apparatus (20) to execute a temperature adjustment operation (preliminary heating operation, preliminary cooling operation) of causing a first temperature (F) to approach a first target temperature (Fs) at a target time point (tg) and causing a second temperature (T) to approach a second target temperature (Ts) at the target time point (tg). The first temperature (F) is a surface temperature of the floor (101) facing the target space (100). The second temperature (T) is an indoor temperature of the target space (100).

Accordingly, it is possible to cause the first temperature (F), which is a surface temperature of the floor (101), and the second temperature (T), which is an indoor temperature of the target space (100), to approach the respective target temperatures (Fs, Ts) at the target time point (tg).

Advantage (10) of First Embodiment

The control method of the present embodiment includes causing the air conditioning apparatus (20) to execute, in the temperature adjustment operation, a first operation (preheating operation, precooling operation) of converging the first temperature (F) to the first target temperature (Fs) and a second operation (normal operation) of converging the second temperature (T) to the second target temperature (Ts).

Accordingly, it is possible to converge the first temperature (F) to the first target temperature (Fs) in the first operation and converge the second temperature (T) to the second target temperature (Ts) in the second operation.

Advantage (11) of First Embodiment

The control method of the present embodiment includes, when the air conditioning apparatus (20) heats the target space (100), in the first operation, causing the air conditioning apparatus (20) to continue an air heating operation even if the second temperature (T) becomes higher than a predetermined value (in this example, the second target temperature (Ts)) that is higher than or equal to the second target temperature (Ts), and in the second operation, causing a heating capacity of the air conditioning apparatus (20) to be lower than in the first operation if the second temperature (T) is higher than the predetermined value (in this example, the second target temperature (Ts)) that is higher than or equal to the second target temperature (Ts).

Accordingly, it is possible to quickly increase the first temperature (F) in the first operation in a heating operation and cause the second temperature (T) to quickly approach the second target temperature (Ts) in the second operation in a heating operation.

Advantage (12) of First Embodiment

The control method of the present embodiment includes, when the air conditioning apparatus (20) cools the target space (100), in the first operation, causing the air conditioning apparatus (20) to continue an air cooling operation even if the second temperature (T) becomes lower than a predetermined value (in this example, the second target temperature (Ts)) that is lower than or equal to the second target temperature (Ts), and in the second operation, causing a cooling capacity of the air conditioning apparatus (20) to be lower than in the first operation if the second temperature (T) is lower than the predetermined value (in this example, the second target temperature (Ts)) that is lower than or equal to the second target temperature (Ts).

Accordingly, it is possible to quickly decrease the first temperature (F) in the first operation in a cooling operation and cause the second temperature (T) to quickly approach the second target temperature (Ts) in the second operation in a cooling operation.

Second Embodiment

A second embodiment will be described. The air conditioning system (10) of the present embodiment is configured to cause the first temperature (F) and the second temperature (T) to approach the respective target temperatures (Fs, Ts) in a shortest time by using artificial intelligence (AI).

The storage unit (72) of the mobile terminal (70) stores a learning model generated using evaluation values and inputs. The evaluation values include a difference between the first temperature (F) and the first target temperature (Fs), a difference between the second temperature (T) and the second target temperature (Ts), and an execution time (total execution time (ttot)) of a temperature adjustment operation (preliminary heating operation, preliminary cooling operation). The inputs include the first temperature (F), the second temperature (T), and the outdoor air temperature (Tout) at start of the temperature adjustment operation, the first execution time (t1) of the first operation (preheating operation, precooling operation), and the second execution time (t2) of the second operation (normal operation). This learning model may be generated by a certain type of machine learning that is performed by associating the foregoing inputs and evaluation values with each other.

In the temperature adjustment operation, the mobile terminal (70) causes the air conditioning apparatus (20) to execute a first operation that uses the first temperature (F) as a control value and a second operation that uses the second temperature (T) as a control value. The mobile terminal (70) controls the air conditioning apparatus (20) so that the difference between the first temperature (F) and the first target temperature (Fs), the difference between the second temperature (T) and the second target temperature (Ts), and the execution time of the temperature adjustment operation become minimum by using the foregoing learning model, based on the first temperature (F), the second temperature (T), and the outdoor air temperature (Tout) detected by the floor temperature sensor (62), the indoor temperature sensor (61), and the outdoor air temperature sensor (63), respectively.

Advantage of Second Embodiment

Also with the control device (70) (mobile terminal (70)) of the present embodiment, advantages similar to those of the first embodiment described above can be obtained.

The control device (70) of the present embodiment is configured to cause the air conditioning apparatus (20) to execute, in the temperature adjustment operation, a first operation that uses the first temperature (F) as a control value and a second operation that uses the second temperature (T) as a control value, generate a learning model using an evaluation value and an input, the evaluation value including a difference between the first temperature (F) and the first target temperature (Fs), a difference between the second temperature (T) and the second target temperature (Ts), and an execution time of the temperature adjustment operation, the input including the first temperature (F), the second temperature (T), and an outdoor air temperature (Tout) at start of the temperature adjustment operation, a first execution time (t1) of the first operation, and a second execution time (t2) of the second operation, and control the air conditioning apparatus (20) so that the evaluation value of the learning model becomes minimum.

Thus, it is possible to cause the first temperature (F) and the second temperature (T) to approach the respective target temperatures (Fs, Ts) while shortening the execution time of the temperature adjustment operation by using the learning model generated by using the individual parameters.

Modification of Second Embodiment

The air conditioning system (10) of the present modification is different from that of the above-described second embodiment in evaluation values of a learning model.

Specifically, the evaluation values of the learning model of the present modification are a difference between the first temperature (F) and the first target temperature (Fs), a difference between the second temperature (T) and the second target temperature (Ts), and a power consumption in the temperature adjustment operation.

In the temperature adjustment operation, the mobile terminal (70) causes the air conditioning apparatus (20) to execute a first operation that uses the first temperature (F) as a control value and a second operation that uses the second temperature (T) as a control value. The mobile terminal (70) controls the air conditioning apparatus (20) so that the difference between the first temperature (F) and the first target temperature (Fs), the difference between the second temperature (T) and the second target temperature (Ts), and the power consumption in the temperature adjustment operation become minimum by using the foregoing learning model, based on the first temperature (F), the second temperature (T), and the outdoor air temperature (Tout) detected by the floor temperature sensor (62), the indoor temperature sensor (61), and the outdoor air temperature sensor (63), respectively.

Also with the control device (70) (mobile terminal (70)) of the present modification, advantages similar to those of the second embodiment described above can be obtained.

The control device (70) of the present modification is configured to cause the air conditioning apparatus (20) to execute, in the temperature adjustment operation, a first operation that uses the first temperature (F) as a control value and a second operation that uses the second temperature (T) as a control value, generate a learning model using an evaluation value and an input, the evaluation value including a difference between the first temperature (F) and the first target temperature (Fs), a difference between the second temperature (T) and the second target temperature (Ts), and a power consumption in the temperature adjustment operation, the input including the first temperature (F), the second temperature (T), and an outdoor air temperature (Tout) at start of the temperature adjustment operation, a first execution time (t1) of the first operation, and a second execution time (t2) of the second operation, and control the air conditioning apparatus (20) so that the evaluation value of the learning model becomes minimum.

Thus, it is possible to cause the first temperature (F) and the second temperature (T) to approach the respective target temperatures (Fs, Ts) while reducing the power consumption of the temperature adjustment operation by using the learning model generated by using the individual parameters.

Third Embodiment

A third embodiment will be described. The air conditioning system (10) of the present embodiment is different from that of the first embodiment in the program installed in the mobile terminal (70) constituting the control device. Thus, the mobile terminal (70) constituting the control device of the present embodiment performs processes different from those of the first embodiment. Now, the processes performed by the mobile terminal (70) constituting the control device of the present embodiment will be described, mainly about differences from the first embodiment.

—Preliminary Heating Operation—

A description will be given of the processes performed by the mobile terminal (70) in a preliminary heating operation of the air conditioning apparatus (20).

The mobile terminal (70) constituting the control device of the present embodiment performs the processes illustrated in the flowchart in FIG. 4, similarly to the first embodiment. However, the mobile terminal (70) of the present embodiment is different from that of the first embodiment in the process of step ST6 in FIG. 4.

The process of step ST6 in FIG. 4 is a process of calculating the first execution time (t1) and the second execution time (t2). The first execution time (t1) in the preliminary heating operation is a time during which the air conditioning apparatus (20) executes a preheating operation (first operation). The second execution time (t2) in the preliminary heating operation is a time during which the air conditioning apparatus (20) executes a normal operation (second operation).

Figure 8:
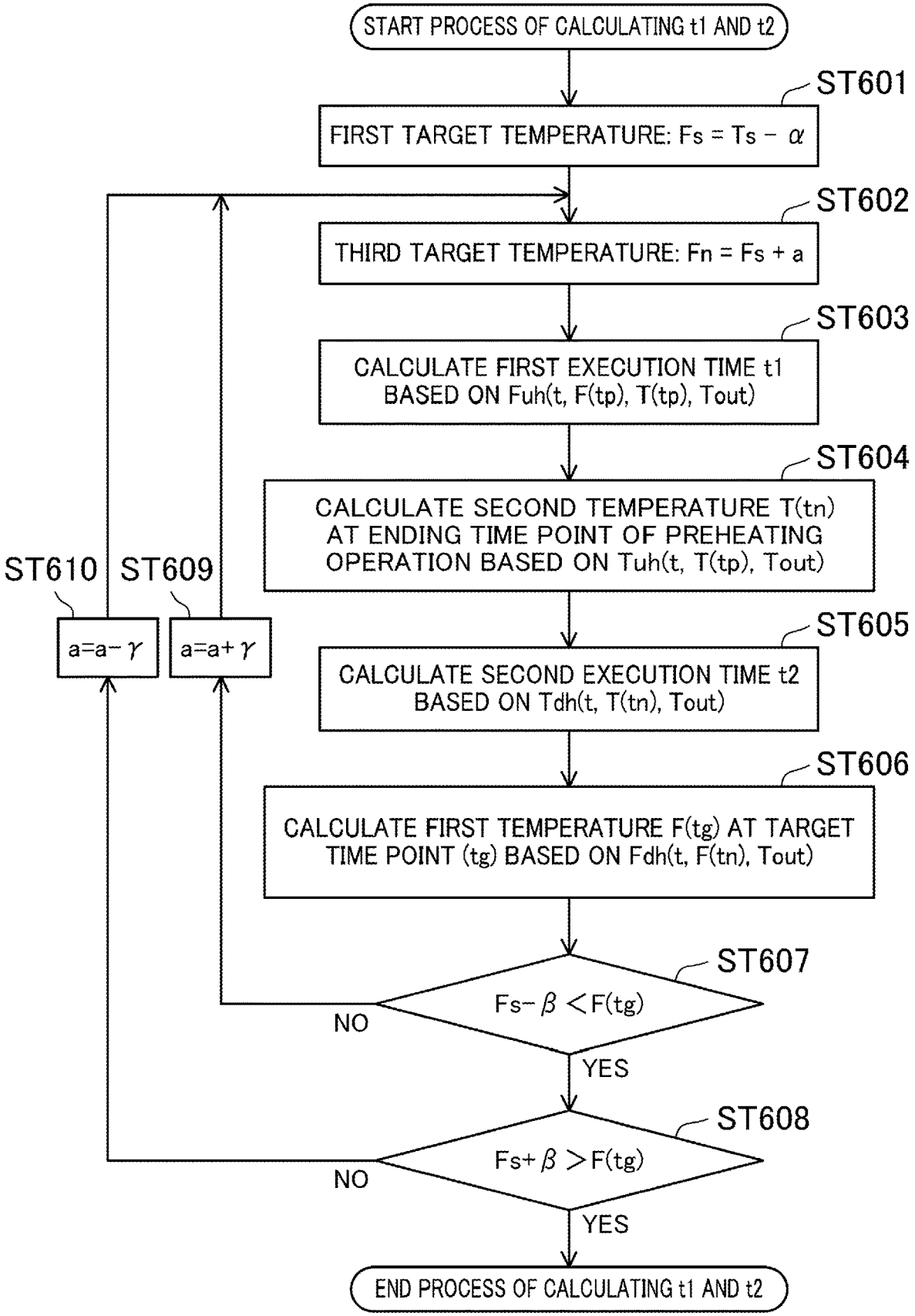
FIG. 8 is a flowchart illustrating a procedure of calculating a first execution time and a second execution time in a preliminary heating operation by the mobile terminal (control device) of a third embodiment.

Now, the process of calculating the first execution time (t1) and the second execution time (t2) by the mobile terminal (70) of the present embodiment will be described with reference to FIG. 8.

In a process of step ST601, the mobile terminal (70) sets a first target temperature (Fs). The first target temperature (Fs) of the present embodiment is a target temperature that the first temperature (F), which is the surface temperature of the floor (101), is to reach at a target time point (tg) designated by a user. In this process, the mobile terminal (70) sets the first target temperature (Fs) to a value calculated by subtracting a predetermined value $\alpha$ from the second target temperature (Ts) ($FS=Ts-\alpha$). The predetermined value $\alpha$ is, for example, "2° C.".

The second target temperature (Ts) is a target value of the second temperature (T), which is the indoor temperature of the target space (100). The second target temperature (Ts) is designated by the user in the process of step ST1 in FIG. 4.

Subsequently, the mobile terminal (70) performs a process of step ST602. In the process of step ST602, the mobile terminal (70) sets a third target temperature (Fn). The third target temperature (Fn) is a target temperature that the first temperature (F), which is the surface temperature of the floor (101), is to reach at an ending time point (tn) of the preheating operation (first operation). In this process, the mobile terminal (70) sets the third target temperature (Fn) to a value calculated by adding a predetermined value a to the first target temperature (Fs) (Fn=Fs+a). The mobile terminal (70) performs the processes from step ST602 to step ST610, thereby adjusting the predetermined value a. An initial value of the predetermined value a is, for example, 1° C.

Subsequently, the mobile terminal (70) performs a process of step ST603. In the process of step ST603, the mobile terminal (70) calculates an estimated value of a time taken from when the air conditioning apparatus (20) starts the preheating operation to when the first temperature (F) reaches the third target temperature (Fn), based on an upward prediction formula Fuh(t, F(tp), T(tp), Tout) of the first temperature (F). The upward prediction formula Fuh(t, F(tp), T(tp), Tout) of the first temperature (F) is a mathematical expression in which an operation time (t), a first temperature F(tp) and a second temperature T(tp) at start of a preheating operation, and an outdoor air temperature (Tout) are variables, and is obtained from past operation history data. The mobile terminal (70) stores the calculated estimated value of the time as the first execution time (t1).

Subsequently, the mobile terminal (70) performs a process of step ST604. In the process of step ST604, the mobile terminal (70) calculates an estimated value of a second temperature T(tn) at a time point (tn) at which the first execution time (t1) calculated in step ST603 has elapsed since the air conditioning apparatus (20) started the preheating operation, based on an upward prediction formula Tuh(t, T(tp), Tout) of the second temperature (T). The upward prediction formula Tuh(t, T(tp), Tout) of the second temperature (T) is a mathematical expression in which an operation time (t), a second temperature T(tp) at start of a preheating operation, and an outdoor air temperature (Tout) are variables, and is obtained from past operation history data.

Subsequently, the mobile terminal (70) performs a process of step ST605. In the process of step ST605, the mobile terminal (70) calculates an estimated value of a time taken from when the operation of the air conditioning apparatus (20) has been switched from the preheating operation to the normal operation to when the second temperature (T) decreases to the second target temperature (Ts), based on a downward prediction formula Tdh(t, T(tn), Tout) of the second temperature (T). The downward prediction formula Td(t, T(tn), Tout) of the second temperature (T) is a mathematical expression in which an operation time (t), a second temperature T(tn) at a time point (tn) at which the first execution time (t1) has elapsed from start of the preheating operation, and an outdoor air temperature (Tout) are variables, and is obtained from past operation history data. The mobile terminal (70) stores the calculated estimated value of the time as the second execution time (t2).

Subsequently, the mobile terminal (70) performs a process of step ST606. In the process of step ST606, the mobile terminal (70) calculates an estimated value of a first temperature F(tg) at a time point (tg) at which the second execution time (t2) calculated in step ST605 has elapsed since the air conditioning apparatus (20) started the normal operation, based on a downward prediction formula Fdh(t, F(tn), Tout) of the first temperature (F). The downward prediction formula Fdh(t, F(tn), Tout) of the first temperature (F) is a mathematical expression in which an operation time (t), a first temperature F(tn) at start of a normal operation, and an outdoor air temperature (Tout) are variables, and is obtained from past operation history data.

Subsequently, the mobile terminal (70) performs a process of step ST607. In the processes from step ST607 to step ST610, the mobile terminal (70) determines whether the estimated value of the first temperature F(tg) calculated in step ST606 is within a target range including the first target temperature (Fs) (in the present embodiment, a range of Fs±β), and performs a predetermined process in accordance with the result.

In the process of step ST607, the mobile terminal (70) compares the estimated value of the first temperature F(tg) calculated in step ST606 with a value calculated by subtracting a predetermined value β from the first target temperature (Fs) (Fs−β). The predetermined value β is, for example, "0.5° C.".

If the first temperature F(tg) is higher than the value (Fs−β) (if Fs−β<F(tg) is satisfied), the mobile terminal (70) performs a process of step ST608. On the other hand, if the first temperature F(tg) is lower than or equal to the value (Fs−β) (if Fs−β<F(tg) is not satisfied), the mobile terminal (70) performs a process of step ST609.

If the first temperature F(tg) is lower than or equal to the value (Fs−β), the estimated value of the first temperature F(tg) calculated in step ST606 is below the target range including the first target temperature (Fs). In this case, the mobile terminal (70) performs the process of step ST609. In the process of step ST609, the mobile terminal (70) increases the value of the predetermined value a used in the process of step ST602 by a predetermined value γ. The predetermined value γ is, for example, 0.1° C. After this process ends, the mobile terminal (70) performs the process of step ST602 again.

In the process of step ST608, the mobile terminal (70) compares the estimated value of the first temperature F(tg) calculated in step ST606 with a value calculated by adding the predetermined value β to the first target temperature (Fs) (Fs+β).

If the first temperature F(tg) is lower than the value (Fs+β) (if Fs+β>F(tg) is satisfied), the estimated value of the first temperature F(tg) calculated in the process of step ST606 is within the target range of the first temperature (F) (the range of Fs±β). In this case, the mobile terminal (70) stores the estimated value of the time calculated in the latest step ST603 as a determined value of the first execution time (t1), stores the estimated value of the time calculated in the latest step ST605 as a determined value of the second execution time (t2), and then ends the process of calculating the first execution time (t1) and the second execution time (t2).

On the other hand, if the first temperature F(tg) is higher than or equal to the value (Fs+β) (if Fs+β>F(tg) is not satisfied), the estimated value of the first temperature F(tg) calculated in the process of step ST606 is above the target range (the range of Fs±β) including the first target temperature (Fs). In this case, the mobile terminal (70) performs a process of step ST610. In the process of step ST610, the mobile terminal (70) decreases the value of the predetermined value a used in the process of step ST602 by the predetermined value γ. After this process ends, the mobile terminal (70) performs the process of step ST602 again.

—Changes in Temperatures in Preliminary Heating Operation—

Figure 9:
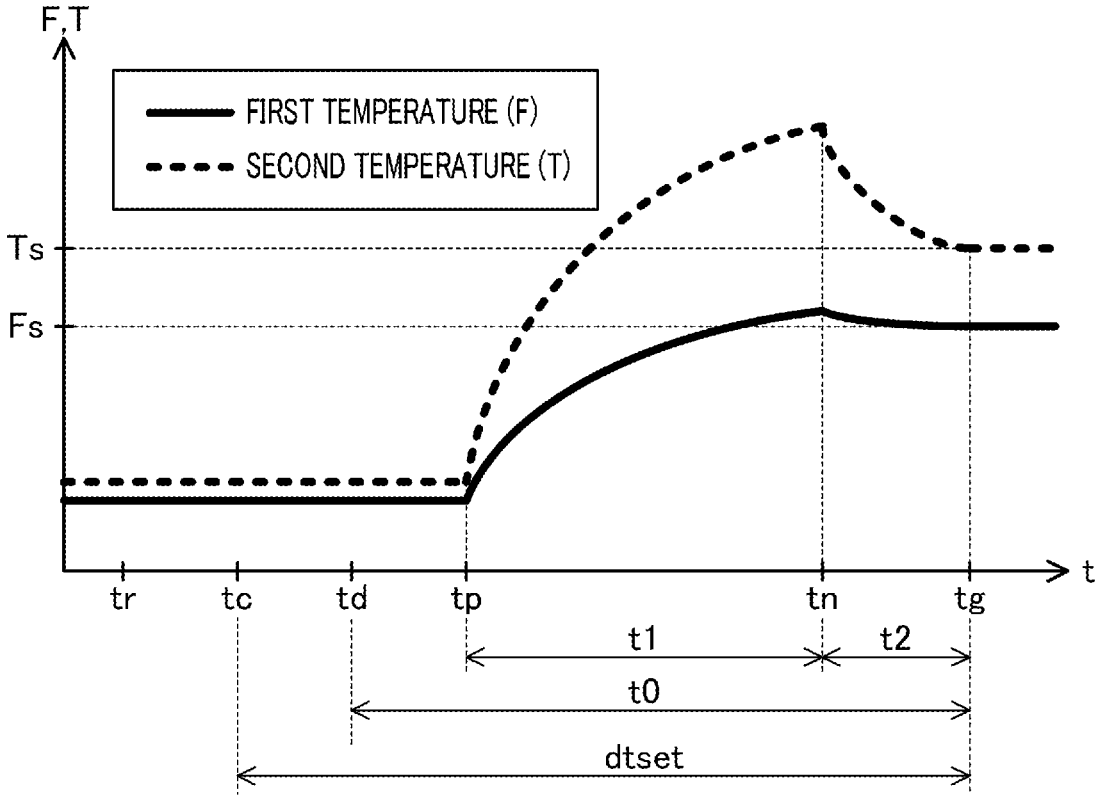
FIG. 9 is a graph illustrating changes in temperatures in a preliminary heating operation of the air conditioning system of the third embodiment.

Changes in the first temperature (F) and the second temperature (T) in a preliminary heating operation of the present embodiment will be described with reference to the graph in FIG. 9.

A preheating operation in a preliminary heating operation is performed over the first execution time (t1). During the preheating operation, the first temperature (F) (the surface temperature of the floor (101)) increases less steeply, whereas the second temperature (T) (the indoor temperature of the target space (100)) increases more steeply. The second temperature (T) becomes higher than the second target temperature (Ts) in the middle of the preheating operation. However, the preheating operation (the air heating operation of the air conditioning apparatus (20)) is continued. On the other hand, the first temperature (F) reaches a third target temperature (Fn) at an ending time point (tn) of the preheating operation. The preheating operation of the present embodiment is an operation of converging the first temperature (F) to the third target temperature (Fn) at the ending time point (tn) of the preheating operation.

The preheating operation is followed by a normal operation, which is performed over the second execution time (t2), in the preliminary heating operation. In the normal operation, the heating capacity of the air conditioning apparatus (20) is lower than in the preheating operation because the second temperature (T) is higher than the second target temperature (Ts). In the example illustrated in FIG. 9, the second temperature (T) is higher than the second target temperature (Ts) at the ending time point (tn) of the preheating operation, and thus the air conditioning apparatus (20) that performs the normal operation is in a state in which the air heating operation is suspended (a so-called thermo-off state).

During the normal operation, the first temperature (F) slightly decreases, whereas the second temperature (T) decreases relatively significantly. The first temperature (F) reaches the first target temperature (Fs) at the ending time point (tg) of the preliminary heating operation. The second temperature (T) reaches the second target temperature (Ts) at the ending time point (tg) of the preliminary heating operation. As described above, the normal operation of the present embodiment is an operation of converging the first temperature (F) to the first target temperature (Fs) and converging the second temperature (T) to the second target temperature (Ts) at the ending time point (tg) of the preliminary heating operation.

—Preliminary Cooling Operation—

A description will be given of the processes performed by the mobile terminal (70) in a preliminary cooling operation of the air conditioning apparatus (20).

The mobile terminal (70) constituting the control device of the present embodiment performs the processes illustrated in the flowchart in FIG. 4, similarly to the first embodiment. However, the mobile terminal (70) of the present embodiment is different from that of the first embodiment in the process of step ST6 in FIG. 4.

The process of step ST6 in FIG. 4 is a process of calculating the first execution time (t1) and the second execution time (t2). The first execution time (t1) in the preliminary cooling operation is a time during which the air conditioning apparatus (20) executes a precooling operation (first operation). The second execution time (t2) in the preliminary cooling operation is a time during which the air conditioning apparatus (20) executes a normal operation (second operation).

Figure 10:
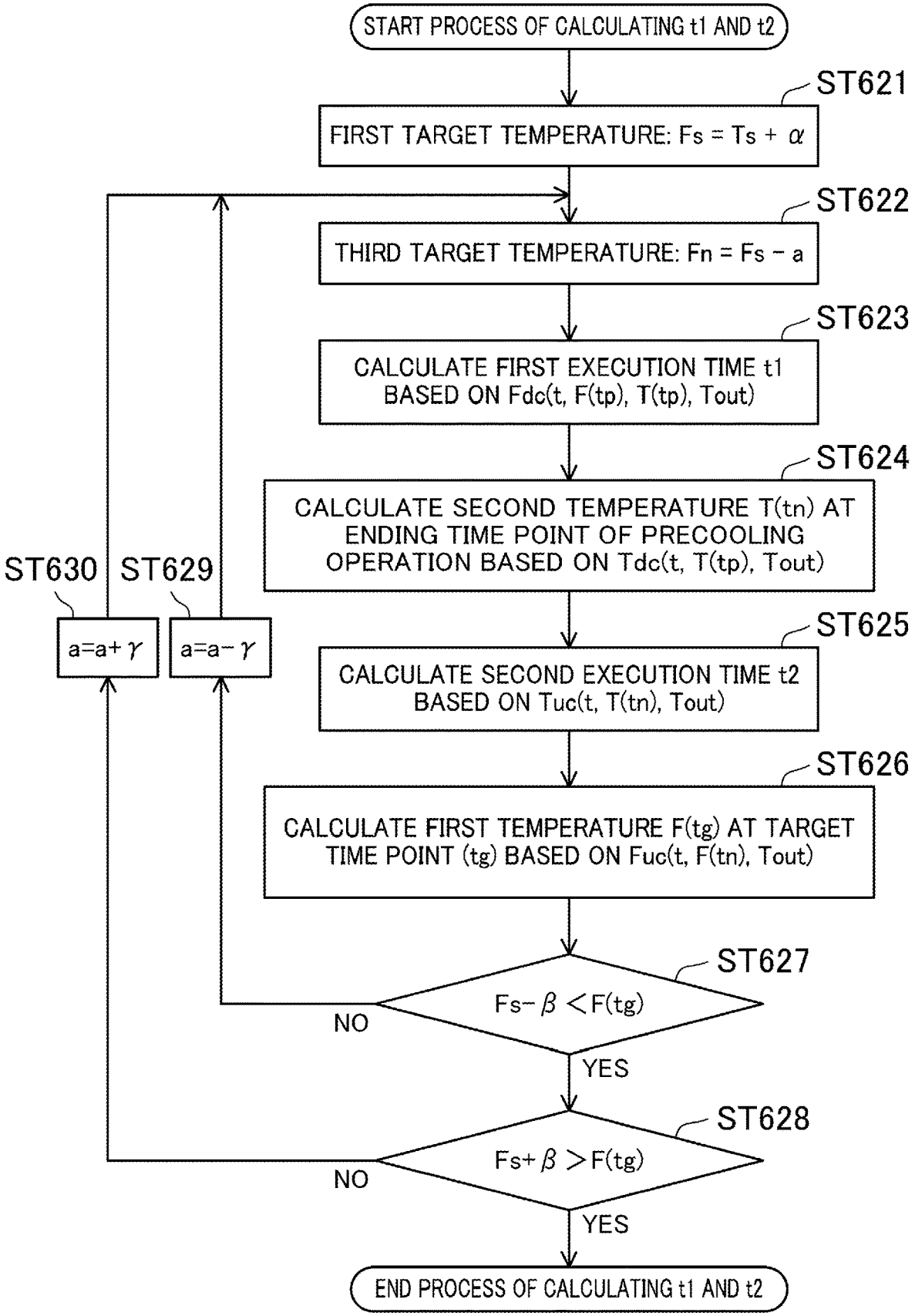
FIG. 10 is a flowchart illustrating a procedure of calculating a first execution time and a second execution time in a preliminary cooling operation by the mobile terminal (control device) of the third embodiment.

Now, the process of calculating the first execution time (t1) and the second execution time (t2) by the mobile terminal (70) of the present embodiment will be described with reference to FIG. 10.

In a process of step ST621, the mobile terminal (70) sets a first target temperature (Fs). The first target temperature (Fs) of the present embodiment is a target temperature that the first temperature (F), which is the surface temperature of the floor (101), is to reach at a target time point (tg) designated by a user. In this process, the mobile terminal (70) sets the first target temperature (Fs) to a value calculated by adding a predetermined value α to the second target temperature (Ts) (FS=Ts+α). The predetermined value α is, for example, "2° C."

The second target temperature (Ts) is a target value of the second temperature (T), which is the indoor temperature of the target space (100). The second target temperature (Ts) is designated by the user in the process of step ST1 in FIG. 4.

Subsequently, the mobile terminal (70) performs a process of step ST622. In the process of step ST622, the mobile terminal (70) sets a third target temperature (Fn). The third target temperature (Fn) is a target temperature that the first temperature (F), which is the surface temperature of the floor (101), is to reach at an ending time point (tn) of the precooling operation (first operation). In this process, the mobile terminal (70) sets the third target temperature (Fn) to a value calculated by subtracting a predetermined value a from the first target temperature (Fs) (Fn=Fs−a). The mobile terminal (70) performs the processes from step ST622 to step ST630, thereby adjusting the predetermined value a. An initial value of the predetermined value a is, for example, 1° C.

Subsequently, the mobile terminal (70) performs a process of step ST623. In the process of step ST623, the mobile terminal (70) calculates an estimated value of a time taken from when the air conditioning apparatus (20) starts the precooling operation to when the first temperature (F) reaches the third target temperature (Fn), based on a downward prediction formula Fdc(t, F(tp), T(tp), Tout) of the first temperature (F). The downward prediction formula Fdh(t, F(tp), T(tp), Tout) of the first temperature (F) is a mathematical expression in which an operation time (t), a first temperature F(tp) and a second temperature T(tp) at start of a precooling operation, and an outdoor air temperature (Tout) are variables, and is obtained from past operation history data. The mobile terminal (70) stores the calculated estimated value of the time as the first execution time (t1).

Subsequently, the mobile terminal (70) performs a process of step ST624. In the process of step ST624, the mobile terminal (70) calculates an estimated value of a second temperature T(tn) at a time point (tn) at which the first execution time (t1) calculated in step ST623 has elapsed since the air conditioning apparatus (20) started the precooling operation, based on a downward prediction formula Tdc(t, T(tp), Tout) of the second temperature (T). The downward prediction formula Tdc(t, T(tp), Tout) of the second temperature (T) is a mathematical expression in which an operation time (t), a second temperature T(tp) at start of a precooling operation, and an outdoor air temperature (Tout) are variables, and is obtained from past operation history data.

Subsequently, the mobile terminal (70) performs a process of step ST625. In the process of step ST625, the mobile terminal (70) calculates an estimated value of a time taken from when the operation of the air conditioning apparatus (20) has been switched from the precooling operation to the normal operation to when the second temperature (T)

increases to the second target temperature (Ts), based on an upward prediction formula Tuc(t, T(tn), Tout) of the second temperature (T). The upward prediction formula Tuc(t, T(tn), Tout) of the second temperature (T) is a mathematical expression in which an operation time (t), a second temperature T(tn) at a time point (tn) at which the first execution time (t1) has elapsed from start of the precooling operation, and an outdoor air temperature (Tout) are variables, and is obtained from past operation history data. The mobile terminal (70) stores the calculated estimated value of the time as the second execution time (t2).

Subsequently, the mobile terminal (70) performs a process of step ST626. In the process of step ST626, the mobile terminal (70) calculates an estimated value of a first temperature F(tg) at a time point (tg) at which the second execution time (t2) calculated in step ST625 has elapsed since the air conditioning apparatus (20) started the normal operation, based on an upward prediction formula Fuc(t, F(tn), Tout) of the first temperature (F). The upward prediction formula Fuc(t, F(tn), Tout) of the first temperature (F) is a mathematical expression in which an operation time (t), a first temperature F(tn) at start of a normal operation, and an outdoor air temperature (Tout) are variables, and is obtained from past operation history data.

Subsequently, the mobile terminal (70) performs a process of step ST627. In the processes from step ST627 to step ST630, the mobile terminal (70) determines whether the estimated value of the first temperature F(tg) calculated in step ST626 is within a target range including the first target temperature (Fs) (in the present embodiment, a range of Fs±β), and performs a predetermined process in accordance with the result.

In the process of step ST627, the mobile terminal (70) compares the estimated value of the first temperature F(tg) calculated in step ST626 with a value calculated by subtracting a predetermined value β from the first target temperature (Fs) (Fs−β). The predetermined value β is, for example, "0.5° C.".

If the first temperature F(tg) is higher than the value (Fs−β) (if Fs−β<F(tg) is satisfied), the mobile terminal (70) performs a process of step ST628. On the other hand, if the first temperature F(tg) is lower than or equal to the value (Fs−β) (if Fs−β<F(tg) is not satisfied), the mobile terminal (70) performs a process of step ST629.

If the first temperature F(tg) is lower than or equal to the value (Fs−β), the estimated value of the first temperature F(tg) calculated in step ST626 is below the target range including the first target temperature (Fs). In this case, the mobile terminal (70) performs the process of step ST629. In the process of step ST629, the mobile terminal (70) decreases the value of the predetermined value a used in the process of step ST622 by a predetermined value γ. The predetermined value γ is, for example, 0.1° C. After this process ends, the mobile terminal (70) performs the process of step ST622 again.

In the process of step ST628, the mobile terminal (70) compares the estimated value of the first temperature F(tg) calculated in step ST626 with a value calculated by adding the predetermined value β to the first target temperature (Fs) (Fs+β).

If the first temperature F(tg) is lower than the value (Fs+β) (if Fs+β>F(tg) is satisfied), the estimated value of the first temperature F(tg) calculated in the process of step ST626 is within the target range of the first temperature (F) (the range of Fs±β). In this case, the mobile terminal (70) stores the estimated value of the time calculated in the latest step ST623 as a determined value of the first execution time (t1), stores the estimated value of the time calculated in the latest step ST625 as a determined value of the second execution time (t2), and then ends the process of calculating the first execution time (t1) and the second execution time (t2).

On the other hand, if the first temperature F(tg) is higher than or equal to the value (Fs+β) (if Fs+β>F(tg) is not satisfied), the estimated value of the first temperature F(tg) calculated in the process of step ST626 is above the target range (the range of Fs±β) including the first target temperature (Fs). In this case, the mobile terminal (70) performs a process of step ST630. In the process of step ST630, the mobile terminal (70) increases the value of the predetermined value a used in the process of step ST622 by the predetermined value γ. After this process ends, the mobile terminal (70) performs the process of step ST622 again.

—Changes in Temperatures in Preliminary Cooling Operation—

Figure 11:
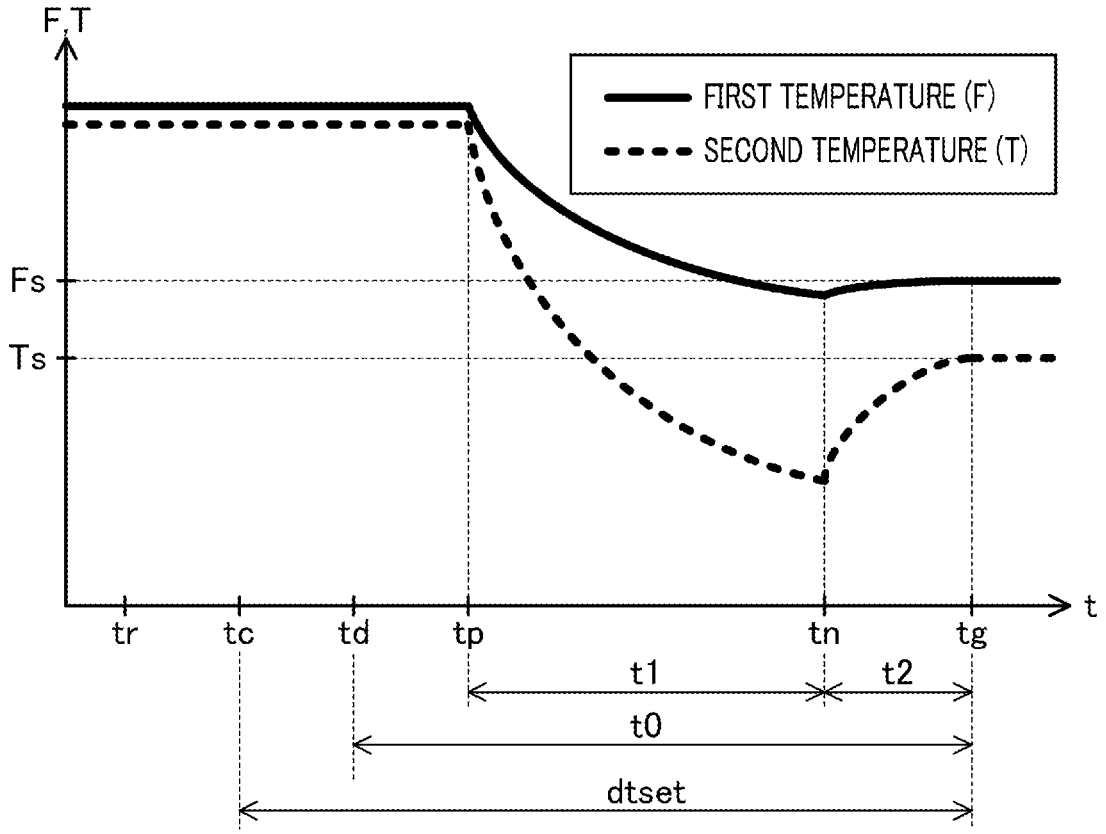
FIG. 11 is a graph illustrating changes in temperatures in a preliminary cooling operation of the air conditioning system of the third embodiment.

Changes in the first temperature (F) and the second temperature (T) in a preliminary cooling operation of the present embodiment will be described with reference to the graph in FIG. 11.

A precooling operation in a preliminary cooling operation is performed over the first execution time (t1). During the precooling operation, the first temperature (F) (the surface temperature of the floor (101)) decreases less steeply, whereas the second temperature (T) (the indoor temperature of the target space (100)) decreases more steeply. The second temperature (T) becomes lower than the second target temperature (Ts) in the middle of the precooling operation. However, the precooling operation (the air cooling operation of the air conditioning apparatus (20)) is continued. On the other hand, the first temperature (F) reaches a third target temperature (Fn) at an ending time point (tn) of the precooling operation. The precooling operation of the present embodiment is an operation of converging the first temperature (F) to the third target temperature (Fn) at the ending time point (tn) of the precooling operation.

The precooling operation is followed by a normal operation, which is performed over the second execution time (t2), in the preliminary cooling operation. In the normal operation, the cooling capacity of the air conditioning apparatus (20) is lower than in the precooling operation because the second temperature (T) is lower than the second target temperature (Ts). In the example illustrated in FIG. 11, the second temperature (T) is lower than the second target temperature (Ts) at the ending time point (tn) of the precooling operation, and thus the air conditioning apparatus (20) that performs the normal operation is in a state in which the air cooling operation is suspended (a so-called thermo-off state).

During the normal operation, the first temperature (F) slightly increases, whereas the second temperature (T) increases relatively significantly. The first temperature (F) reaches the first target temperature (Fs) at the ending time point (tg) of the preliminary cooling operation. The second temperature (T) reaches the second target temperature (Ts) at the ending time point (tg) of the preliminary cooling operation. As described above, the normal operation of the present embodiment is an operation of converging the first temperature (F) to the first target temperature (Fs) and converging the second temperature (T) to the second target temperature (Ts) at the ending time point (tg) of the preliminary cooling operation.

Advantage (1) of Third Embodiment

The control device (70) constituted by the mobile terminal of the present embodiment is configured to cause the air conditioning apparatus (20) to execute, in the temperature adjustment operation, a first operation of converging the first temperature (F) to a third target temperature (Fn) and a second operation of converging the first temperature (F) to the first target temperature (Fs) and converging the second temperature (T) to the second target temperature (Ts), in an order of the first operation and the second operation.

According to the present embodiment, it is possible to converge the first temperature (F) to the third target temperature (Fn) in a preheating operation or a precooling operation, which is a first operation. According to the present embodiment, it is possible to converge the first temperature (F) to the first target temperature (Fs) and converge the second temperature (T) to the second target temperature (Ts) in a normal operation, which is a second operation.

Advantage (2) of Third Embodiment

The control device (70) of the present embodiment is configured to, in the temperature adjustment operation executed when the air conditioning apparatus (20) heats the target space (100), set the first target temperature (Fs) to a value lower than the second target temperature (Ts). As a result, it is possible to avoid the first temperature (F), which is the temperature of the floor (101), from becoming too high, and increase the comfort of a person in a room.

The control device (70) of the present embodiment is configured to, in the temperature adjustment operation executed when the air conditioning apparatus (20) cools the target space (100), set the first target temperature (Fs) to a value higher than the second target temperature (Ts). As a result, it is possible to avoid the first temperature (F), which is the temperature of the floor (101), from becoming too low, and increase the comfort of a person in a room.

Other Embodiments

The above-described embodiments may have the following configurations.

—First Modification—

In each of the above-described embodiments, the mobile terminal (70) constitutes the control device, but an element of the control device may be selected as appropriate. For example, the mobile terminal (70) and the control unit (50) of the air conditioning apparatus (20) may constitute the control device, a server (not illustrated) capable of communicating with the mobile terminal (70) and the control unit (50) may constitute the control device, or any of the mobile terminal (70), the control unit (50), and the server may constitute the control device.

—Second Modification—

In each of the above-described embodiments, the computer constituting the control device is not limited to the mobile terminal (70). In this specification, a "computer" is a "machine that stores a program describing a calculation procedure (algorithm) and automatically executes calculation in accordance with the stored program". Thus, the control device of each of the above-described embodiments may be constituted by, for example, a tablet PC, a server, a remote controller of the air conditioning apparatus (20), or the like.

—Third Modification—

In each of the above-described embodiments, the mobile terminal (70) may be configured to, in a preheating operation of a preliminary heating operation, continue an air heating operation of the air conditioning apparatus (20) even if the second temperature (T) becomes higher than a predetermined value that is higher than the second target temperature (Ts) (for example, a value higher than the second target temperature (Ts) by 2 to 3° C.)

—Fourth Modification—

In each of the above-described embodiments, the mobile terminal (70) may be configured to, in a precooling operation of a preliminary cooling operation, continue an air cooling operation of the air conditioning apparatus (20) even if the second temperature (T) becomes lower than a predetermined value that is lower than the second target temperature (Ts) (for example, a value lower than the second target temperature (Ts) by 2 to 3° C.)

—Fifth Modification—

In each of the above-described embodiments, the first target temperature (Fs) may be a set value input by a user. In the above-described first or second embodiment, the first target temperature (Fs) may be a temperature determined based on the second target temperature (Ts) (for example, a temperature lower than the second target temperature (Ts) by 2 to 3° C. in a heating operation, and a temperature higher than the second target temperature (Ts) by 2 to 3° C. in a cooling operation).

The embodiments and modifications have been described above. It is to be understood that the embodiments and the details can be variously changed without deviating from the gist and scope of the claims. The above embodiments and modifications may be combined or replaced as appropriate as long as target functions of the present disclosure are not impaired.

INDUSTRIAL APPLICABILITY

As described above, the present disclosure is useful to a control device for an air conditioning apparatus, an air conditioning system, a control method for an air conditioning apparatus, and a program.

REFERENCE SIGNS LIST

10 air conditioning system
20 air conditioning apparatus
70 mobile terminal (control device)
100 target space
101 floor (partition portion)
F first temperature
Fs first target temperature
T second temperature
Ts second target temperature
Tout outdoor air temperature
t1 first execution time
t2 second execution time
ttot total execution time

The invention claimed is:

1. A control device configured to control an air conditioning apparatus configured to perform at least one of cooling by blowing out cooled air and heating by blowing out heated air into a target space, wherein the control device is configured to cause the air conditioning apparatus to execute a temperature adjustment operation of causing a first temperature to approach a first target temperature by the air blown out from the air conditioning apparatus at a target time point and causing a second temperature to approach a second target temperature at the target time point by the air blown out from the air conditioning apparatus, the first temperature being a surface temperature of a partition portion including at least one of a floor, a wall, and a ceiling facing the target space, the second temperature being an indoor temperature of the target space.

2. The control device according to claim 1, wherein the control device is configured to cause the air conditioning apparatus to execute, in the temperature adjustment operation, a first operation of converging the first temperature to the first target temperature and a second operation of converging the second temperature to the second target temperature.

3. The control device according to claim 2, wherein the control device is configured to cause the air conditioning apparatus to execute, in the temperature adjustment operation, the first operation and the second operation in an order of the first operation and the second operation.

4. The control device according to claim 3, wherein the control device is configured to, when the air conditioning apparatus heats the target space, in the first operation, cause the air conditioning apparatus to continue heating the target space even if the second temperature becomes higher than a predetermined value that is higher than or equal to the second target temperature, and in the second operation, cause a heating capacity of the air conditioning apparatus to be lower than in the first operation if the second temperature is higher than the predetermined value that is higher than or equal to the second target temperature.

5. The control device according to claim 3, wherein the control device is configured to, when the air conditioning apparatus cools the target space, in the first operation, cause the air conditioning apparatus to continue cooling the target space even if the second temperature becomes lower than a predetermined value that is lower than or equal to the second target temperature, and in the second operation, cause a cooling capacity of the air conditioning apparatus to be lower than in the first operation if the second temperature is lower than the predetermined value that is lower than or equal to the second target temperature.

6. The control device according to claim 3, wherein the control device is configured to before the air conditioning apparatus starts operating, estimate a first execution time of the first operation and a second execution time of the second operation, based on past learning data, and cause the air conditioning apparatus to start the first operation at a time point that is a total execution time or more before the target time point, the total execution time being a sum of the first execution time and the second execution time.

7. The control device according to claim 6, wherein the control device is configured to, before the air conditioning apparatus starts operating, estimate the first execution time from when the first operation to be presently executed starts to when the first temperature converges to the first target temperature, based on the learning data including the first temperature, an outdoor air temperature, and the second temperature in a past first operation, and also based on a currently obtained first temperature, a currently obtained outdoor air temperature, and a currently obtained second temperature that are currently obtained.

8. The control device according to claim 3, wherein the control device is configured to, before the air conditioning apparatus starts operating, estimate a second execution time from when the second operation to be presently executed starts to when the second temperature converges to the second target temperature, based on learning data including an outdoor air temperature and the second temperature in a past first operation, on the second temperature that is estimated from the learning data and that is to be obtained at start of the second operation to be presently executed, and on a current outdoor air temperature.

9. The control device according to claim 2, wherein the first target temperature is an estimated value of the first temperature that is to be obtained when a change rate of the first temperature becomes lower than or equal to a predetermined value in the first operation.

10. The control device according to claim 1, wherein the control device is configured to cause the air conditioning apparatus to execute, in the temperature adjustment operation, a first operation of converging the first temperature to a third target temperature and a second operation of converging the first temperature to the first target temperature and converging the second temperature to the second target temperature, in an order of the first operation and the second operation.

11. The control device according to claim 10, wherein the control device is configured to, in the temperature adjustment operation executed when the air conditioning apparatus heats the target space, set the first target temperature to a value lower than the second target temperature.

12. The control device according to claim 10, wherein the control device is configured to, in the temperature adjustment operation executed when the air conditioning apparatus cools the target space, set the first target temperature to a value higher than the second target temperature.

13. The control device according to claim 10, wherein the control device is configured to before the air conditioning apparatus starts operating, estimate a first execution time of the first operation and a second execution time of the second operation, based on past learning data, and cause the air conditioning apparatus to start the first operation at a time point that is a total execution time or more before the target time point, the total execution time being a sum of the first execution time and the second execution time.

14. The control device according to claim 13, wherein the control device is configured to, before the air conditioning apparatus starts operating, estimate the first execution time from when the first operation to be presently executed starts to when the first temperature converges to the third target temperature, based on the learning data including the first temperature, an outdoor air temperature, and the second temperature in a past first operation, and also based on a currently obtained first temperature, a currently obtained outdoor air temperature, and a currently obtained second temperature that are currently obtained.

15. The control device according to claim 1, wherein the first target temperature is a set value input by a user.

16. The control device according to claim 1, wherein the first target temperature is a temperature determined based on the second target temperature.

17. The control device according to claim 1, wherein the control device is configured to cause the air conditioning apparatus to execute, in the temperature adjustment operation, a first operation that uses the first temperature as a control value and a second operation that uses the second temperature as a control value, generate a learning model using an evaluation value and an input, the evaluation value including a difference between the first temperature and the first target temperature, a difference between the second temperature and the second target temperature, and an execution time of the temperature adjustment operation, the input including the first temperature, the second temperature, and an outdoor air temperature at start of the temperature adjustment operation, a first execution time of the first operation, and a second execution time of the second operation, and control the air conditioning apparatus so that the evaluation value of the learning model becomes minimum.

18. The control device according to claim 1, wherein the control device is configured to cause the air conditioning apparatus to execute, in the temperature adjustment operation, a first operation that uses the first temperature as a control value and a second operation that uses the second temperature as a control value, generate a learning model using an evaluation value and an input, the evaluation value including a difference between the first temperature and the first target temperature, a difference between the second temperature and the second target temperature, and a power consumption in the temperature adjustment operation, the input including the first temperature, the second temperature, and an outdoor air temperature at start of the temperature adjustment operation, a first execution time of the first operation, and a second execution time of the second operation, and control the air conditioning apparatus so that the evaluation value of the learning model becomes minimum.

19. An air conditioning system comprising:

the control device according to claim 1; and an air conditioning apparatus configured to be controlled by the control device and perform at least one of cooling and heating of a target space.

20. A control method for an air conditioning apparatus configured to perform at least one of cooling by blowing out cooled air and heating by blowing out heated air into a target space, comprising:

causing the air conditioning apparatus to execute a temperature adjustment operation of causing a first temperature to approach a first target temperature by the air blown out from the air conditioning apparatus at a target time point and causing a second temperature to approach a second target temperature at the target time point by the air blown out from the air conditioning apparatus, the first temperature being a surface temperature of a partition portion including at least one of a floor, a wall, and a ceiling facing the target space, the second temperature being an indoor temperature of the target space.

21. The control method according to claim 20, further comprising:

causing the air conditioning apparatus to execute, in the temperature adjustment operation, a first operation of converging the first temperature to the first target temperature and a second operation of converging the second temperature to the second target temperature.

22. The control method according to claim 20, further comprising:

causing the air conditioning apparatus to execute, in the temperature adjustment operation, a first operation of converging the first temperature to a third target temperature and a second operation of converging the first temperature to the first target temperature and converging the second temperature to the second target temperature, in an order of the first operation and the second operation.

23. A non-transitory storage media that stores a program that causes a computer to execute a process of controlling an air conditioning apparatus configured to perform at least one of cooling by blowing out cooled air and heating by blowing out heated air into a target space, wherein the program causes the computer to execute a process of causing the air conditioning apparatus to execute a temperature adjustment operation of causing a first temperature to approach a first target temperature by the air blown out from the air conditioning apparatus at a target time point and causing a second temperature to approach a second target temperature at the target time point by the air blown out from the air conditioning apparatus, the first temperature being a surface temperature of a partition portion including at least one of a floor, a wall, and a ceiling facing the target space, the second temperature being an indoor temperature of the target space.

24. The non-transitory storage media that stores the program according to claim 23, wherein the program causes the computer to execute a process of causing the air conditioning apparatus to execute, in the temperature adjustment operation, a first operation of converging the first temperature to the first target temperature and a second operation of converging the second temperature to the second target temperature.

25. The non-transitory storage media that stores the program according to claim 23, wherein the program causes the computer to execute a process of causing the air conditioning apparatus to execute, in the temperature adjustment operation, a first operation of converging the first temperature to a third target temperature and a second operation of converging the first temperature to the first target temperature and converging the second temperature to the second target temperature, in an order of the first operation and the second operation.

* * * * *